US007832028B2

(12) United States Patent
Yayama et al.

(10) Patent No.: US 7,832,028 B2
(45) Date of Patent: Nov. 16, 2010

(54) FINE-BUBBLE GENERATOR, AND FOOT-BATHING APPARATUS AND BATHING DEVICE WITH THE SAME

(75) Inventors: Toshihiko Yayama, 159-13, Ogimachi, Ogi-shi, Saga 845-0001 (JP); Hisatsune Nashiki, Kumamoto (JP); Ichiro Teshiba, Kumamoto (JP); Tatsuhiko Takase, Kumamoto (JP); Hironori Tanaka, Kumamoto (JP); Takaaki Iwasaki, Kumamoto (JP)

(73) Assignees: Tashizen Techno Works Co., Ltd., Kumamoto (JP); Toshihiko Yayama, Saga (JP)

( * ) Notice: Subject to any disclaimer, the term of this patent is extended or adjusted under 35 U.S.C. 154(b) by 830 days.

(21) Appl. No.: 11/663,740

(22) PCT Filed: Sep. 27, 2005

(86) PCT No.: PCT/JP2005/017770

§ 371 (c)(1),
(2), (4) Date: Mar. 26, 2007

(87) PCT Pub. No.: WO2006/035782

PCT Pub. Date: Apr. 6, 2006

(65) Prior Publication Data

US 2008/0072373 A1 Mar. 27, 2008

(30) Foreign Application Priority Data

Sep. 28, 2004 (JP) ..... 2004-281462
Oct. 26, 2004 (JP) ..... 2004-311361
Apr. 19, 2005 (JP) ..... 2005-121360

(51) Int. Cl.
*A61H 33/02* (2006.01)

(52) U.S. Cl. ..... 4/541.4; 4/541.1; 4/622; 261/79.2; 261/23.1; 261/123

(58) Field of Classification Search ..... 4/541.1–541.6, 4/559, 349, 574.1, 622; 261/74, 79.2, 23.1, 261/123

See application file for complete search history.

(56) References Cited

U.S. PATENT DOCUMENTS 4,853,987 A * 8/1989 Jaworski ..... 4/541.6

(Continued)

FOREIGN PATENT DOCUMENTS

JP 1-30185 9/1989

(Continued)

*Primary Examiner*—Gregory L Huson
*Assistant Examiner*—Janie Christiansen
(74) *Attorney, Agent, or Firm*—Wenderoth, Lind & Ponack, L.L.P.

(57) ABSTRACT

A fine-bubble generator is capable of supplying a fluid mixed with a large quantity of fine bubbles into a fluid without causing an unnecessary liquid flow and turbulent flow in the objective fluid. The fine-bubble generator is constructed by arranging two fine-bubble generating sections in a rectangular parallelepiped casing with spouts of the fine-bubble generating sections facing each other. The fine-bubble generating sections have fluid rotating chambers each composed of a circumferential wall provided around an imaginary center line and partition walls arranged at both ends of the circumferential wall, liquid introducing passages provided so as to communicate with the fluid rotating chambers in order to introduce a liquid along a direction that forms a position twisted relative to the imaginary center line, gas introducing passages opened in the partition wall of each of the fluid rotating chambers in order to introduce a gas into each of the fluid rotating chambers, and spouts opened in the partition walls.

9 Claims, 19 Drawing Sheets

U.S. PATENT DOCUMENTS

| | | | | |
|---|---|---|---|---|
| 4,907,305 | A * | 3/1990 | Teramachi et al. | 4/541.4 |
| 6,382,601 | B1 | 5/2002 | Ohnari | |

FOREIGN PATENT DOCUMENTS

| | | | |
|---|---|---|---|
| JP | 2-31761 | | 2/1990 |
| JP | 7-39828 | | 7/1995 |
| JP | 11-188070 | | 7/1999 |
| JP | 11-300183 | | 11/1999 |
| JP | 2000-350762 | | 12/2000 |
| JP | 2001-112662 | | 4/2001 |
| JP | 2002011335 | A * | 1/2002 |
| JP | 2003-205228 | | 7/2003 |
| JP | 2004-89391 | | 3/2004 |
| JP | 2006150049 | A * | 6/2006 |
| JP | 2006320509 | A * | 11/2006 |

* cited by examiner

FINE-BUBBLE GENERATOR, AND FOOT-BATHING APPARATUS AND BATHING DEVICE WITH THE SAME

TECHNICAL FIELD

The present invention relates to a fine-bubble generator for supplying fluid mixed with fine bubbles into various kinds of fluids such as freshwater, seawater and other liquids as well as a foot-bathing apparatus and a bathing device using the fine-bubble generator.

BACKGROUND ART

Supplying bubbles (air) into freshwater or seawater causes an increase of dissolved oxygen and other changes in the water. It is widely known that such changes provide a variety of excellent effects, which have been utilized in many industrial fields including plant cultivation, aquafarming, wastewater treatment, or the like. When bubbles are supplied into water, it is known to be effective to minimize the outer diameter of the bubbles to increase the surface area of the bubbles relative to the volume of the bubbles, thereby enlarging the contact area between air in the bubbles and the water. Accordingly, an example of a fine bubble production apparatus capable of supplying a large amount of fine bubbles into water is described in Patent Document 1.

The fine bubble production apparatus disclosed in Patent Document 1 is constituted of a vessel main body having a conical space, a pressurized liquid introducing port opened in the tangential direction at a part of an inside wall circumferential surface of the space, a gas introducing port opened in a bottom part of the conical space, and a swirling gas-liquid introducing port opened at a top part of the conical space. While keeping this fine bubble production apparatus submerged in water, water is supplied into the pressurized liquid introducing port and, simultaneously, air is supplied into the gas introducing port. Then, a gas-liquid swirling flow is generated, and water mixed with fine bubbles is discharged from the swirling gas-liquid introducing port into water.

Meanwhile, it has been known that immersing feet in hot water is comfortable and refreshing and, recently, some foot-bathing apparatuses having vessels for immersing the feet have been developed. In addition, a foot-bathing apparatus described in Patent Document 2, for example, not only warms the feet by soaking the feet in hot water but also has a massaging effect by generating bubbles in hot water. This foot-bathing apparatus (foot bathing vessel) has a tub for storing water, a fan for sending air into the tub, a foot pedestal for placing feet provided on the bottom of the tub, and a vibrator for vibrating the tub. The air blown by the fan is discharged from bubble holes provided on the bottom of the tub as bubbles to massage the bottoms of the feet soaking in the tub.

It has also been widely known that bubbles generated in a bathtub when bathing moderately stimulate the bather's skin, which provides a massaging and refreshing effect. Examples of generating bubbles in hot water by sending air with pressure to a bubble-generating means disposed at a bottom of a bathtub are described in Patent Documents 3 and 4. Other examples of generating bubbles in hot water by introducing air into a bubble-generator which is put in a bathtub are described in Patent Documents 5 and 6.

Patent Document 1: Unexamined Japanese Patent Publication No. 2003-205228

Patent Document 2: Unexamined Japanese Patent Publication No. 2000-350762

Patent Document 3: Unexamined Japanese Patent Publication No. 2004-089391

Patent Document 4: Unexamined Japanese Patent Publication No. 2001-112662

Patent Document 5: Unexamined Japanese Utility Model Publication No. H07-039828

Patent Document 6: Unexamined Japanese Patent Publication No. H11-188070

It is possible to supply fine bubbles into water by discharging water mixed with fine bubbles by use of the fine bubble production apparatus disclosed in Patent Document 1. In order to supply a larger quantity of fine bubbles, however, it is necessary to increase the amount of water and air to be supplied to the rotational fine bubble production apparatus or to make the apparatus larger in size.

On the other hand, if the amount of water and air to be supplied is increased, though the total quantity of the fine bubbles spouted would become large, the outer diameter of the bubbles would also grow, which may deteriorate the characteristics of fine bubbles. Furthermore, since the velocity and quantity of the water mixed with fine bubbles which is discharged from the swirling gas-liquid introducing port are increased, while the bubbles are favorably dispersed up to distant regions in water, an unnecessary water flow and a turbulent flow are caused in water, which may lead to harmful results depending on the purpose of use.

A first object to be achieved by the present invention is to provide a fine bubble generator capable of supplying a fluid mixed with a large quantity of fine bubbles into a fluid to be treated without causing an unnecessary liquid flow and turbulent flow in the objective fluid.

In the foot-bathing apparatus (foot bathing vessel) described in Patent Document 2, bubbles are produced by discharging air blown from the fan through air bubble passing holes provided on the bottom part of the tub. Since the outer diameter of the bubbles generated in this way is relatively large and measurable on the order of millimeters, most of the generated bubbles rapidly rise up in the liquid and then burst on the surface of the liquid and disappear. Therefore, the only effect obtained by these bubbles is a massaging effect or a circulating effect of hot water in the vessel.

Accordingly, a second object to be achieved by the present invention is to provide a foot-bathing apparatus which is superior to conventional foot-bathing apparatuses in its blood circulation enhancing effect, sedating effect, and autonomic nerve controlling effect.

It is further noted that the outer diameters of the bubbles produced by the bubble generators described in Patent Documents 3 to 6 are relatively large and measurable on the order of millimeters. Thus, the bubbles sent to hot water rapidly rise up in the water and then burst on the surface of the water and disappear. Therefore, the only effect obtained by these bubbles is a massaging effect to the bather or a circulating effect of hot water in the tub.

Accordingly, a third object to be achieved with the present invention is to provide a bathing device which has a superior blood circulation enhancing effect, sedating effect, and autonomic nerve controlling effect.

SUMMARY OF THE INVENTION

A fine-bubble generator of the present invention has two fine-bubble generating sections, each of the fine-bubble generating sections comprising a fluid rotating chamber defined by a circumferential wall provided around an imaginary center line and partition walls arranged at both ends of the circumferential wall in the direction of the imaginary center line. A liquid introducing passage is provided so as to communicate with the fluid rotating chamber for introducing a liquid along a direction that forms a position twisted relative to the imaginary center line, a gas introducing passage is opened in one of the partition walls of the fluid rotating chamber for introducing a gas into the fluid rotating chamber, and a spout is opened in the other of the partition walls of the fluid rotating chamber. The two fine-bubble generating sections are arranged with the spouts to face each other.

In the above structure, by supplying a liquid into each of the fluid rotating chambers through the liquid introducing passage, the liquid is fed into the fluid rotating chamber along the direction that forms the position twisted relative to the imaginary center line of each of the fluid rotating chambers. Thus, in each of the fluid rotating chambers, a rotational flow rotating around the imaginary center line is generated to form a negative-pressure zone along the imaginary center line which is a central portion of the fluid rotating chamber. Therefore, a gas (air, for example) is introduced into each of the fluid rotating chambers through the gas introducing passage opened in one of the partition walls of each of the fluid rotating chambers, thereby forming a gas-liquid rotational flow in each of the fluid rotating chambers.

This negative-pressure zone is also called a vortex cavitation. An apical end portion of the grown vortex cavitation is torn off by the gas-liquid rotational flow to form a fluid mixed with a large quantity of fine bubbles, which is spouted from the spout opened in the other of the partition walls of each of the fluid rotating chambers. The fluids mixed with fine bubbles which are spouted from the two spouts arranged to face each other collide with each other to largely slacken the flow velocity and then gradually diffuse into the surrounding fluid. Therefore, an unnecessary liquid flow and turbulent flow are not generated in the fluid to be treated, and the fluid mixed with a large quantity of fine bubbles can be supplied into the objective fluid. At the time when the fine-bubble generating sections are discharging the fluid mixed with fine bubbles into the objective fluid, it has been observed that ultrasonic waves having a frequency of 28 kHz or more are generated in a band continuing from an audible area.

In this case, preferably, the two fine-bubble generating sections may be arranged to be opposite to each other so that the imaginary center lines of the fluid rotating chambers form an angle of 180±5 degrees and so that fluid rotational flows generated in the fluid rotating chambers rotate in the same direction. By this structure, the rotational flows of the fluid mixed with fine bubbles spouted to face each other from the spouts of the two fine-bubble generating sections are positioned in alignment with each other, thereby further improving the effect of slackening the flow velocity by the synergetic effect. Here, by arranging the two fine-bubble generating sections so that the directions of the fluid rotational flows generated in the fluid rotating chambers are opposite, the effect of slackening the flow velocity in the rotating direction can be enhanced.

Preferably, the two spouts arranged to face each other may have a mixing chamber therebetween to communicate with the spouts, and a discharge port may be provided in a part of the mixing chamber for discharging a fluid mixed with fine bubbles spouted into the mixing chamber to the outside. By this structure, the fluids mixed with fine bubbles spouted from the spouts are stirred in the mixing chamber while colliding with each other and then discharged from the discharge port. Thus, the flow velocity is further slackened, thereby preventing an unnecessary liquid flow and turbulent flow to be created. In addition, the position of discharging the fluid mixed with fine bubbles is limited to the discharge port, which enables the fine bubbles to discharge in a desired direction.

Next, a foot-bathing apparatus of the present invention comprises a foot-bathing vessel having a capacity which can accommodate at least a part of a body extremity below an ankle, the fine-bubble generator submerged in a liquid contained in the foot-bathing vessel, liquid supplying means for supplying a liquid via the liquid introducing passage to the fine-bubble generator, and a gas channel for supplying a gas via the gas introducing passage to the fine-bubble generator. By this structure, a liquid is supplied from the liquid supplying means to the fine-bubble generator submerged in a fluid in the foot-bathing apparatus, and the liquid mixed with fine bubbles is spouted from each of the spouts. In this manner, a fluid mixed with a large quantity of fine bubbles can be supplied to the liquid in the foot-bathing apparatus while ultrasonic waves having a frequency of 28 kHz or more are generated in a band continuing from an audible area at the same time. Accordingly, with the effects of the large amount of fine bubbles supplied to the liquid in the foot-bathing apparatus and the ultrasonic waves, it is possible to obtain a blood circulation enhancing effect, a sedating effect, and an autonomic nerve controlling effect on the foot bathed in the liquid.

For instance, it is said that the ultrasonic waves generating approximately 500 $mW/cm^2$ of output in a frequency band from 30 kHz to 1 MHz are effective in soothing arthritic pain and that the ultrasonic waves generating approximately 1 $W/cm^2$ of output in a frequency band from 10 kHz to 1 MHz effectively promote healing of a bone fracture. Here, by using a heated liquid as the liquid in the foot-bathing apparatus, effects by heating can also be obtained in addition to the various effects mentioned above.

By providing an oxygen enriching device in a part of the gas channel or the gas introducing passage, air in which the oxygen concentration has been increased by the oxygen enriching device can be supplied to the fluid rotating chamber. Therefore, the fluid mixed with a large quantity of fine bubbles containing a higher amount of oxygen than that of the atmosphere is spouted from the spouts. Then, the oxygen vaporizing out of the liquid in the foot-bathing vessel increases the oxygen concentration in an upper part of the foot-bathing vessel, providing a refreshing effect. Moreover, since a liquid containing a high amount of dissolved oxygen also has a pain-relieving effect on the human body, the oxygen enriching device provided on a part of the gas introducing passage can enhance a sedating effect.

Next, a bathing device of the present invention comprises the fine-bubble generator, liquid supplying means for supplying a liquid to the fine-bubble generator via the liquid introducing passage, and a gas channel for supplying a gas to the fine-bubble generator via the gas introducing passage. By this structure, to the fine-bubble generator submerged in hot water in a bathtub, hot water is supplied from the liquid supplying means, and the hot water mixed with fine bubbles is spouted from each of the spouts. In this manner, a fluid mixed with a large quantity of fine bubbles can be supplied to the hot water. By conducting the above operation with the bathing device placed in the air, the liquid mixed with a large amount of fine bubbles can be spouted toward an object such as a part of the human body.

When the hot water mixed with fine bubbles is spouted from each of the spouts as described above, ultrasonic waves having a frequency of 28 kHz or more are generated in a band continuing from an audible area at the same time. Accordingly, with the generated ultrasonic waves, it is possible to obtain a blood circulation enhancing effect, a sedating effect, and an autonomic nerve controlling effect on the body immersed in the hot water or showered with the hot water mixed with fine bubbles.

Here, by providing an oxygen enriching device in a part of the gas channel or the gas introducing passage, air in which oxygen concentration has been increased by the oxygen enriching device can be supplied into the fluid rotating chamber. Therefore, the fluid mixed with a large quantity of fine bubbles containing a higher amount of oxygen than the oxygen in the atmosphere can be spouted from the spouts toward the hot water in a bathtub. Then, the oxygen vaporizing out of the hot water in the bathtub increases the oxygen concentration in an upper part of the bathtub, providing a refreshing effect to the bather. Moreover, since hot water containing a high amount of dissolved oxygen also has a pain-relieving effect on the human body, it is possible to obtain a sedating effect on a painful body part.

ADVANTAGES OF THE INVENTION

With the fine-bubble generator according to the present invention, a fluid mixed with a large quantity of fine bubbles can be supplied to the fluid to be treated without causing an unnecessary liquid flow and turbulent flow in the objective fluid.

In addition, with the foot-bathing apparatus according to the present invention, it is possible to obtain an excellent blood circulation enhancing effect, sedating effect, and autonomic nerve controlling effect.

Furthermore, with the bathing device according to the present invention, it is possible to obtain an excellent blood circulation enhancing effect, sedating effect, and autonomic nerve controlling effect.

EXPLANATION OF REFERENCE NUMERALS

Figure 1:
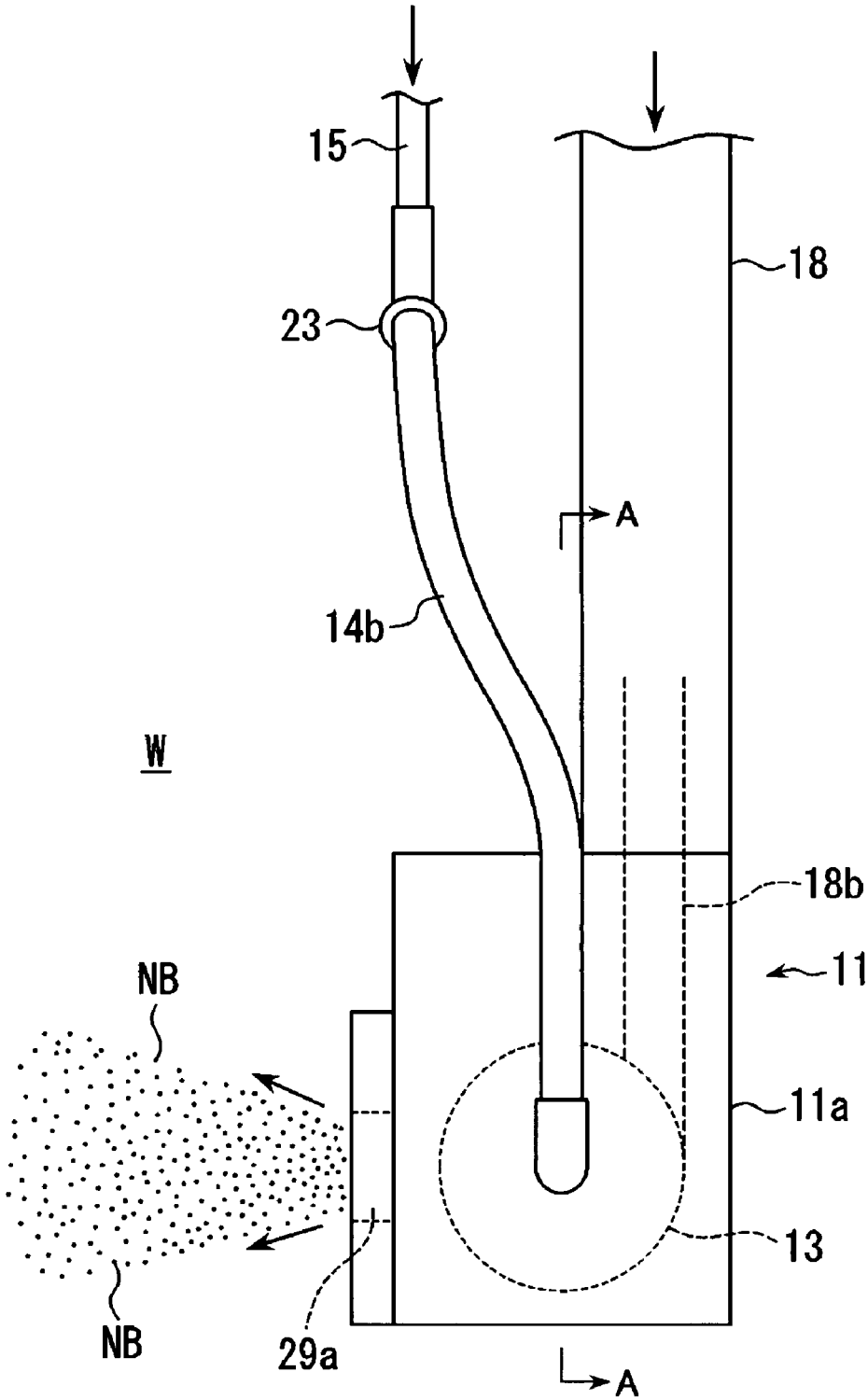
FIG. 1 is a side view illustrating a fine-bubble generator of an embodiment of the present invention.

10: foot-bathing apparatus
11: fine-bubble generator
11*a*: casing
12, 13: fine-bubble generating section
14*a*, 14*b*, 15: gas introducing passage
16: oxygen enriching device
16*a*: oxygen enriching membrane
17, 19: filter
18, 18*a*, 18*b*: liquid introducing passage
20: cushion material
21: concaved surface
22: drain
22*a*: open/close cap
23: branching member
24: gas-liquid supplying unit
25: fluid rotating chamber
25*a*, 25*b*: partition wall
25*c*: imaginary center line
25*d*: circumferential wall
25*p*: auxiliary rotating section
26: gas introducing port
27: liquid introducing port
28*b*, 28*b*: spout
29: mixing chamber
29*a*: discharge port
30: cultivating vessel
31: culture media
32: foot-bathing vessel
32*x*: container tank
32*a*: bottom plate
33: electrothermal heating element
40: bathing device
AP: air pump
BR: bathroom
BT: bathtub
F: foot
F1: sole portion
HW: hot water
NB: fine bubble
P: pump
R: rotational flow
V: negative-pressure zone
W: water

DETAILED DESCRIPTION THE INVENTION

Figure 2:
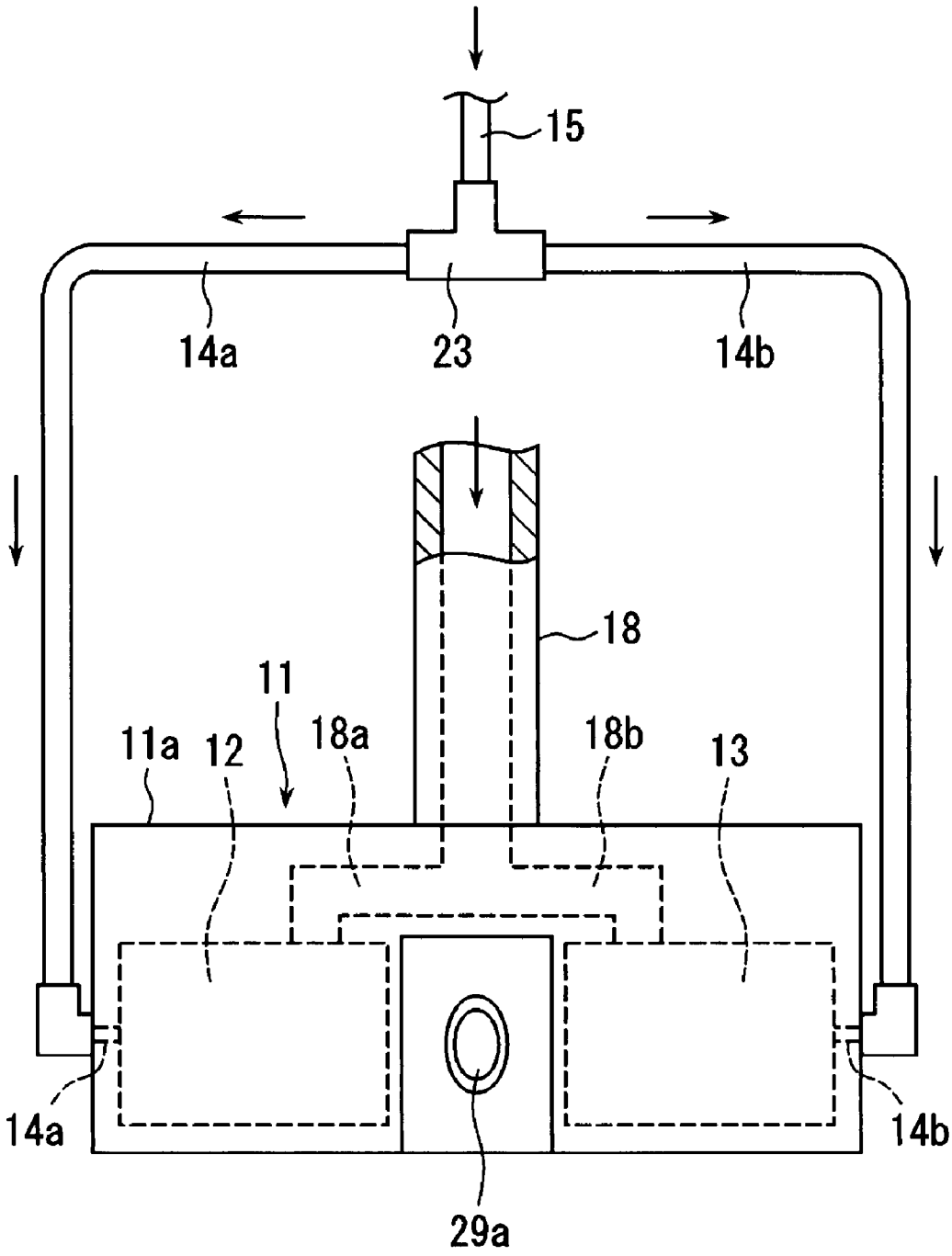
FIG. 2 is a front view of the fine-bubble generator in FIG. 1.
Figure 3:
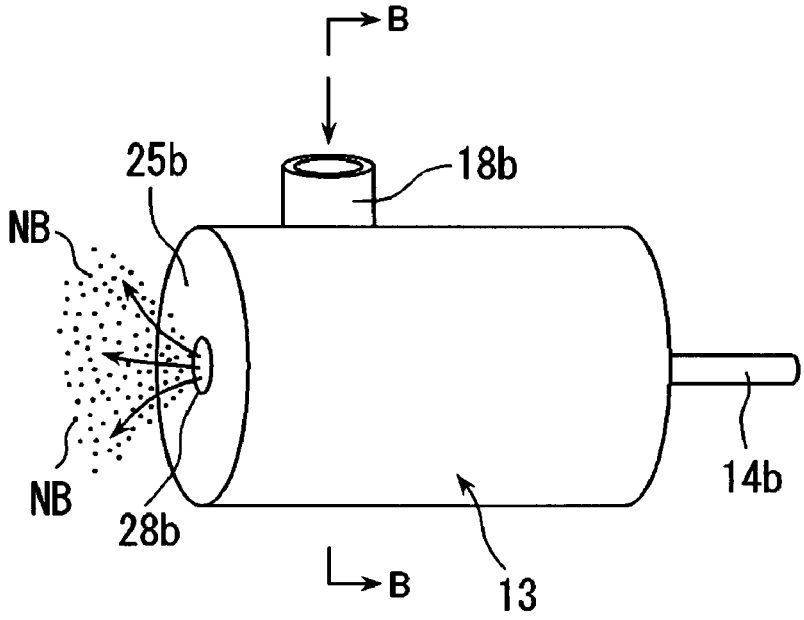
FIG. 3 is a perspective view of a fine-bubble generating section constituting the fine-bubble generator in FIG. 1.
Figure 4:
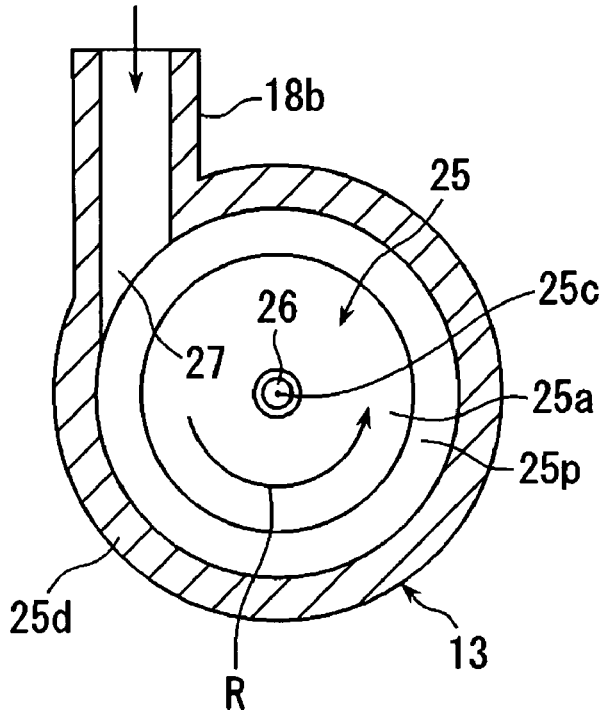
FIG. 4 is a sectional view taken along the line B-B in FIG. 3.
Figure 5:
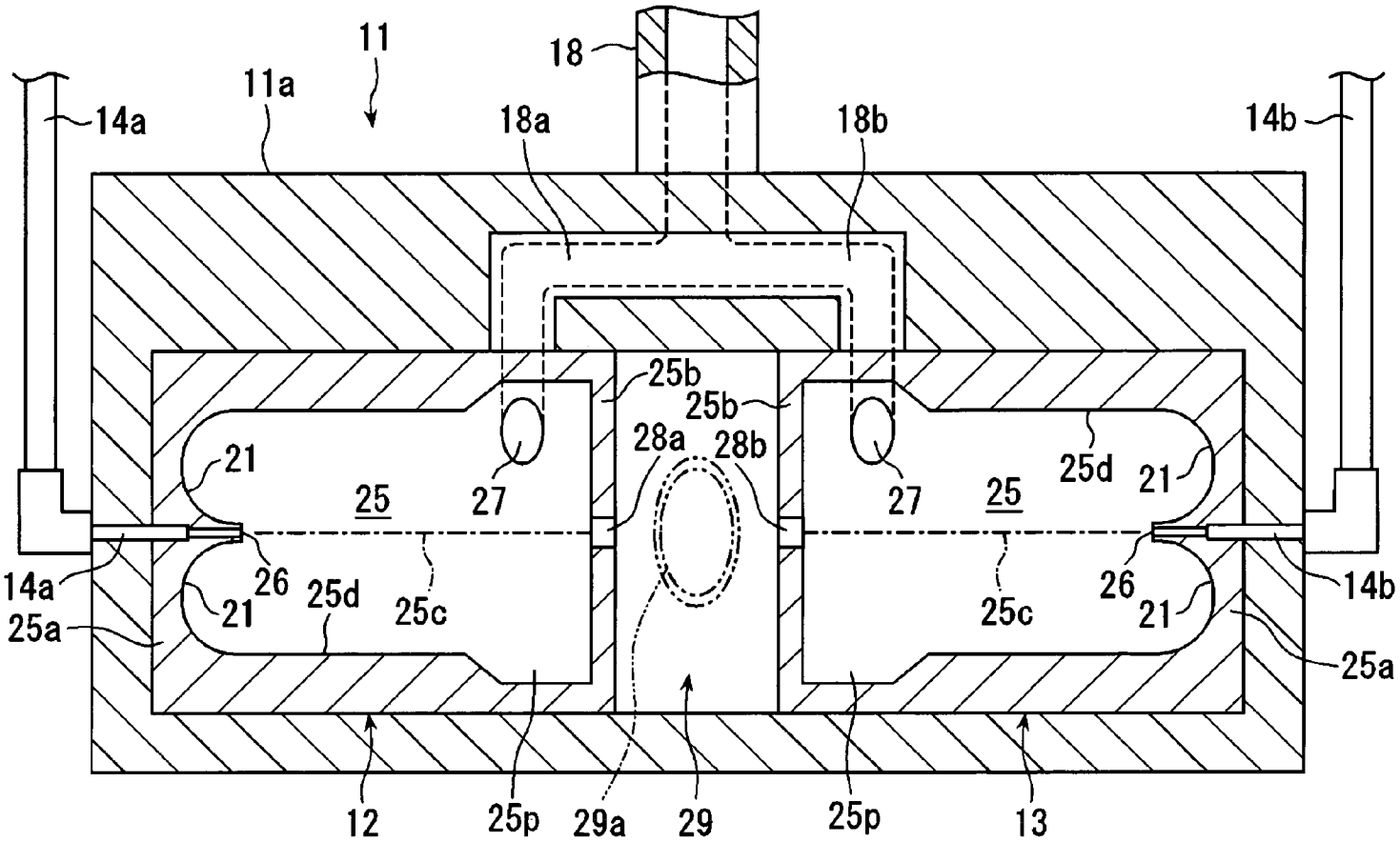
FIG. 5 is a sectional view taken along the line A-A in FIG. 1.
Figure 6:
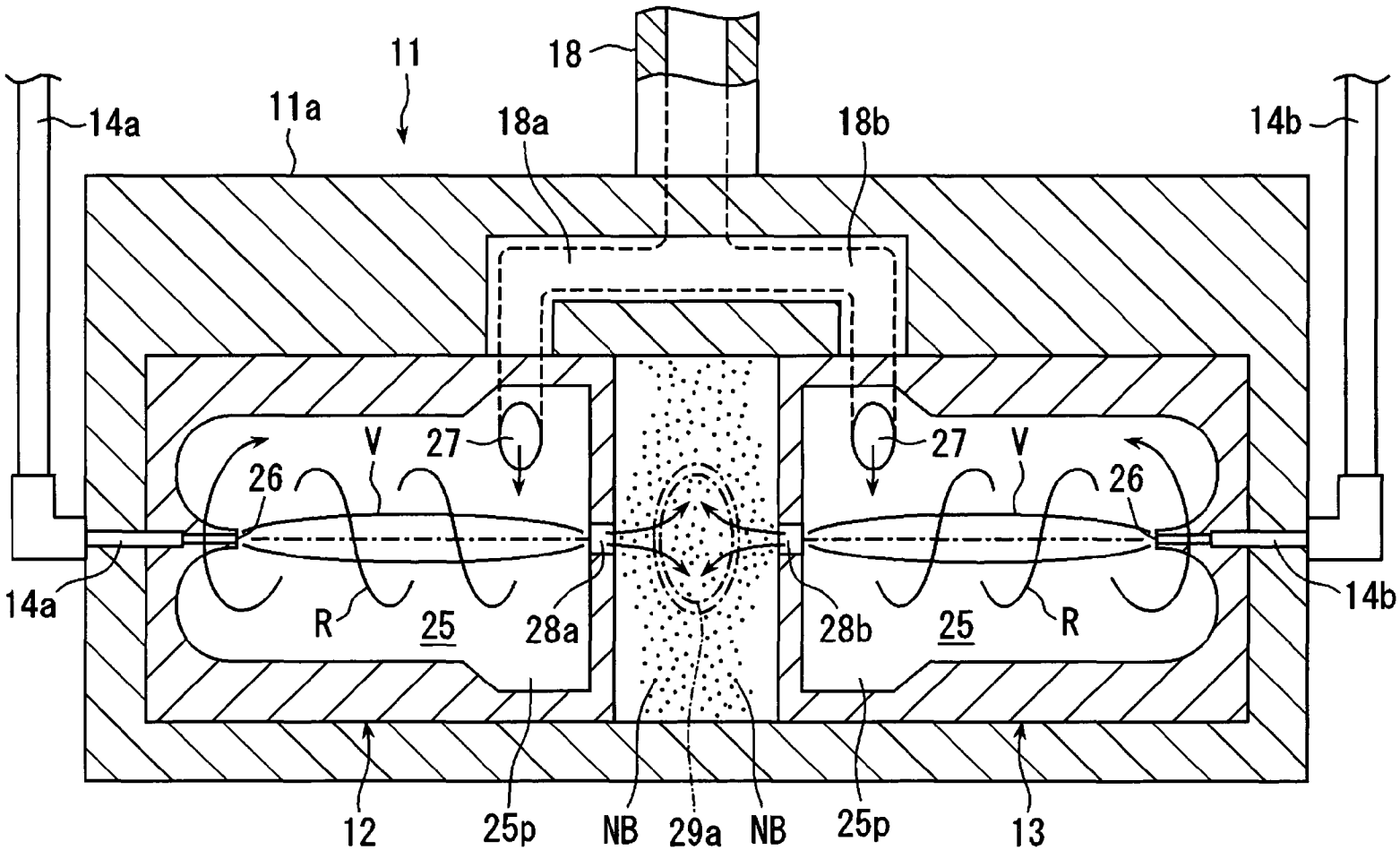
FIG. 6 is a sectional view illustrating a state in which fine bubbles are generated in the fine-bubble generator in FIG. 5.
Figure 7:
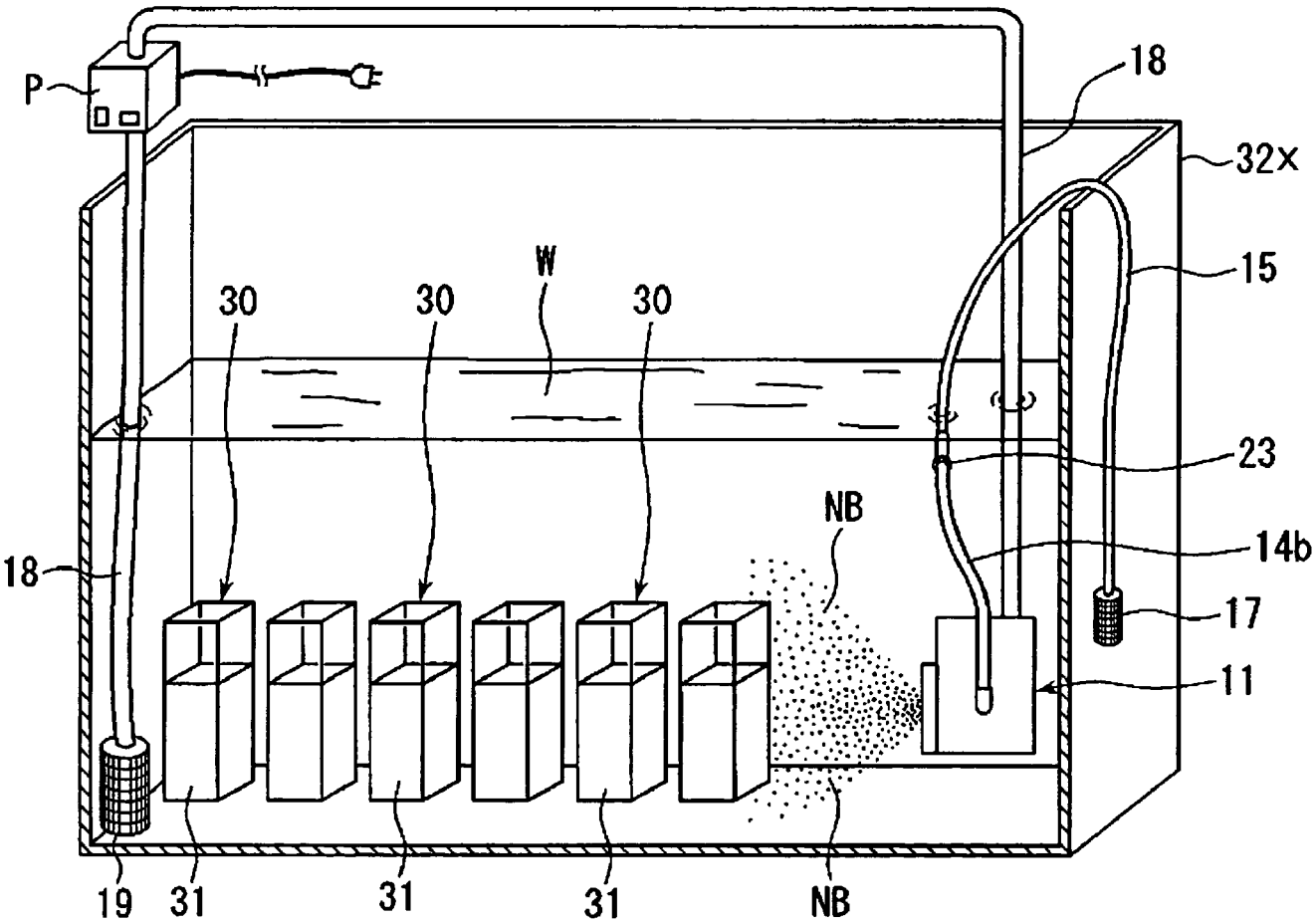
FIG. 7 is a drawing illustrating an example of the use of the fine-bubble generator in FIG. 1.

Referring to FIGS. 1 to 7, a fine-bubble generator of an embodiment of the present invention is explained below. FIG. 1 is a side view illustrating a fine-bubble generator of an embodiment of the present invention; FIG. 2 is a front view of the fine-bubble generator in FIG. 1; FIG. 3 is a perspective view of a fine-bubble generating section constituting the fine-bubble generator in FIG. 1; FIG. 4 is a sectional view taken along the line B-B in FIG. 3;

FIG. 5 is a sectional view taken along the line A-A in FIG. 1; FIG. 6 is a sectional view illustrating a state where fine bubbles are generated in the fine-bubble generator in FIG. 5; and FIG. 7 is a drawing illustrating an example of use of the fine-bubble generator in FIG. 1.

As shown in FIGS. 1 to 5, a fine-bubble generator 11 is composed of two fine-bubble generating sections 12 and 13 which are arranged in a substantially rectangular parallelepiped casing 11*a* with spouts 28*a* and 28*b* of the bubble generating sections 12 and 13, respectively, to face each other. The fine-bubble generating sections 12 and 13 are provided with fluid rotating chambers 25 defined by circumferential walls 25*d* provided around imaginary center lines 25*c* and partition walls 25*a* and 25*b* arranged at both ends of the circumferential walls 25*d* in the direction of the imaginary center lines 25*c*, liquid introducing passages 18*a* and 18*b* provided so as to communicate with the fluid rotating chambers 25 for introducing a liquid into the fluid rotating chambers 25 along a direction that forms a position twisted relative to the imaginary center lines 25*c*, gas introducing passages 14*a* and 14*b* opened in one of the partition walls 25*a* of the fluid rotating chambers 25 for introducing a gas into the fluid rotating chambers 25, and spouts 28*a* and 28*b* opened in the other of the partition walls 25*b* of the fluid rotating chambers 25.

Upstream ends of the two gas introducing passages 14*a* and 14*b* are connected to a gas introducing passage 15 via a branching member 23. Air in the atmosphere or the like is supplied to the fine-bubble generating sections 12 and 13 in the fine-bubble generator 11 via the gas introducing passages 14*a* and 14*b*. Upstream ends of the liquid introducing passages 18*a* and 18*b* are connected to a main liquid introducing passage 18 so that a liquid supplied via the liquid introducing passage 18 is supplied to the fine-bubble generating sections 12 and 13 through the liquid introducing passages 18*a* and 18*b*.

Then, with reference to FIGS. 3 to 6, a structure, function and the like of the fine-bubble generating sections 12 and 13 are explained. As shown in FIG. 5, the fine-bubble generating sections 12 and 13, which are arranged in the casing 11*a*, have structures to form mirror symmetry and are provided with the same components. Therefore, only the fine-bubble generating section 13 is explained below, and the description of the fine-bubble generating section 12 is omitted by assigning the same reference numerals to the same components.

The fine-bubble generating section 13 is provided with the fluid rotating chamber 25 defined by the circumferential wall 25*d* provided around the imaginary center line 25*c* and the partition walls 25*a* and 25*b* arranged at both ends of the circumferential wall 25*d* in the direction of the imaginary center line 25*c*, the liquid introducing passage 18*b* (18*a*) provided so as to communicate with the fluid rotating chamber 25 for introducing a liquid (hot water HW) along a direction that forms a position twisted relative to the imaginary center line 25*c*, the gas introducing passage 14*b* (14*a*) opened in the partition wall 25*a* on one side of the fluid rotating chamber 25 for introducing a gas (air) into the fluid rotating chamber 25, and the spout 28*b* (28*a*) opened in the partition wall 25*b* on the other side of the fluid rotating chamber 25. The liquid introducing passage 18*b* (18*a*) communicates with the fluid rotating chamber 25 through a liquid introducing port 27, and the gas introducing passage 14*b* (14*a*) communicates with the fluid rotating chamber 25 through a gas introducing port 26.

As shown in FIG. 7, while the fine-bubble generator 11 and a filter 19 of the liquid introducing passage 18 are submerged in water W in a container tank 32*x*, a pump P is operated. Then, the water W sucked from the container tank 32*x* through the filter 19 and the liquid introducing passage 18 flows from the liquid introducing port 27 through the liquid introducing passages 18*a* and 18*b* into the fluid rotating chamber 25, which generates a rotational flow R in the fluid rotating chamber 25 as shown in FIG. 6. Then, approximately along a center line of the rotational flow R, a negative-pressure zone V having a substantially cylindrical shape appears. An end portion on one side of the negative-pressure zone V is positioned near the gas introducing port 26 opened in the partition wall 25*a* of the fluid rotating chamber 25 whereas an end portion on the other side of the negative-pressure zone V is positioned near the spouts 28*a* and 28*b* opened in the partition wall 25*b* of the fluid rotating chamber 25. The end portion positioned near the spouts 28*a* and 28*b* has a constricted form.

Thus, a negative pressure of the negative-pressure zone V formed in the fluid rotating chamber 25 causes a negative pressure also around the gas introducing port 26. Therefore, a sucking force due to the negative pressure allows the air sucked from the atmosphere through the filter 17 and the gas introducing passages 15, 14*a* and 14*b* to continuously flow from the gas introducing port 26 into the negative-pressure zone V in the fluid rotating chamber 25, thereby forming the rotational flow R with the water W introduced into the fluid rotating chamber 25.

The air flowing into the negative-pressure zone V is pulled in with the rotational flow R generated in the fluid rotating chamber 25 and emitted from the spouts 28*a* and 28*b*. Here, the air is wrenched off at the end portion of the negative-pressure zone V on the side of the spouts 28*a* and 28*b* by the rotational flow R to form fine bubbles NB, which are mixed with the fluid (the water W) forming the rotational flow R to produce the fluid (the water W) mixed with the fine bubbles NB, and the resultant fluid is emitted from each of the spouts 28*a* and 28*b* into a mixing chamber 29. The mixing chamber 29 is provided between the fine-bubble generating sections 12 and 13 arranged to be opposite to each other, and communicates with the spouts 28*a* and 28*b* of the fine-bubble generating sections 12 and 13, respectively.

The fluids (the water W) mixed with the fine bubbles NB which are spouted from the spouts 28*a* and 28*b* of the fine-bubble generating sections 12 and 13 into the mixing chamber 29 collide with each other while circulating within the mixing chamber 29, and then are discharged from a discharge port 29*a* opened in the casing 11*a* into the water W in the container tank 32*x*.

As described above, by discharging the liquid (the water W) mixed with the fine bubbles NB into the water W from the discharge port 29*a*, gases such as oxygen or nitrogen can be supplied and dissolved into the water W in the container tank 32*x*. Therefore, the liquid (the water W) mixed with the fine bubbles NB containing a high amount of dissolved oxygen evenly and softly circulates in the container tank 32*x*, thereby equally supplying oxygen or other gases to culture medium 31 (transparent gel, for example) in a plurality of cultivating vessels 30 submerged in the water W in the container tank 32*x*. Furthermore, since no unnecessary liquid flow or turbulent flow is generated in the water W in the container tank 32*x*, there is no harmful effect on bacteria cultured in the culture medium 31, for example.

In the fine-bubble generator 11, the fluids (the water W) mixed with the fine bubbles NB spouted from the spouts 28*a* and 28*b* of the two fine-bubble generating sections 12 and 13 arranged to be opposite to each other collide with each other to largely slacken the flow velocity, and then gradually diffuse into the surrounding water W. Accordingly, the water W mixed with a large quantity of the fine bubbles NB can be supplied into the water W to be treated without causing an unnecessary liquid flow or turbulent flow in the objective water W. While the fine-bubble generating sections 12 and 13 are spouting the water W mixed with the fine bubbles NB into the objective water W, it has been observed that ultrasonic waves having a frequency of 28 kHz or more are generated in a band continuing from an audible area at the same time.

The two fine-bubble generating sections 12 and 13 are arranged to be opposite to each other so that the imaginary center lines 25*c* of the fluid rotating chambers 25 form an angle of 180 degrees and so that the rotational flows R generated in the fluid rotating chambers 25 rotate in the same direction (see arrow near gas introduction port 26 in FIG. 6). Therefore, the rotational flows of the water W mixed with the fine bubbles NB spouted to face each other from the spouts 28*a* and 28*b* of the two fine-bubble generating sections 12 and 13 are positioned in alignment with each other, thereby further improving the effect of slackening the flow velocity by the synergetic effect. In this case, the rotating directions of the rotational flows R generated in the fluid rotating chambers 25 are not limited in the form illustrated in FIG. 6. Thus, the two fine-bubble generating sections 12 and 13 may be arranged in the other way, or a pair of the fine-bubble generating sections 12 or a pair of the fine-bubble generating sections 13 may be arranged to be opposite to each other. Also, it is possible to supply the water W to the two fine-bubble generating sections 12 and 13 with two pumps individually, or to supply air to the two fine-bubble generating sections 12 and 13 with one or two air pumps.

Furthermore, the two spouts 28*a* and 28*b* arranged to face each other have the mixing chamber 29 therebetween to communicate with the spouts 28*a* and 28*b*, and the discharge port 29*a* is provided in a part of the mixing chamber 29 for discharging the water W mixed with the fine bubbles NB to an outside. Accordingly, the waters W mixed with the fine bubbles NB spouted from the spouts 28*a* and 28*b* are stirred in the mixing chamber 29 while colliding with each other and then discharged from the discharge port 29*a*. Thus, the flow velocity is further slackened, thereby preventing an unnecessary liquid flow and turbulent flow to be caused in the container tank 32*x*. In addition, the position of discharging the water W mixed with the fine bubble NB is limited to the discharge port 29*a*, which also enables the fine bubbles NB to discharge in a desired direction. Here, in order to softly discharge the water W mixed with the fine bubbles NB from the discharge port 29*a*, it is necessary to make a cross-sectional area of an opening of the discharge port 29*a* larger than a total of cross-sectional areas of openings of the spouts 28*a* and 28*b*.

On the other hand, inside the fine-bubble generating sections 12 and 13, air is introduced from one end of the negative-pressure zone V appearing in the fluid rotating chamber 25 while the water W mixed with the fine bubbles NB is discharged toward a direction extending from the other end. Thus, the negative-pressure zone V continues to be present around the imaginary center line 25*c* of the fluid rotating chamber 25 in a stable manner, with both ends thereof being stably positioned near the gas introducing port 26 and the spouts 28*a* and 28*b*, respectively. Accordingly, the negative-pressure zone V does not touch an inner face of the fluid rotating chamber 25, for example, and no cavitation erosion occurs in the fine-bubble generating sections 12 and 13, providing excellent durability.

The fine-bubble generating sections 12 and 13 have a simple structure in which the liquid introducing port 27, the gas introducing port 26, and the spouts 28*a* and 28*b* are opened in the fluid rotating chamber 25 having a substantially cylindrical shape, and thus are easy to use. In addition, there are no small passages which are apt to be clogged with foreign matters fed in with the water W or air, making the fine-bubble generating sections 12 and 13 free of regular maintenance and easy to use.

As shown in FIG. 5, the gas introducing port 26 opened in the partition wall 25*a* of the fluid rotating chamber 25 is arranged to project inwardly along the imaginary center line 25*c* of the fluid rotating chamber 25, and a concave surface 21 having a smoothly continuous face is provided between the circumferential wall 25*d* of the fluid rotating chamber 25 and the gas introducing port 26. By this structure, as shown in FIG. 6, air is introduced from the end portion of the negative-pressure zone V formed in the fluid rotating chamber 25 on the side of the partition wall 25*a*, and the fluid (the water W) mixed with the fine bubbles NB is spouted toward the direction extending from the end portion on the side of the partition wall 25*b*. Thus, the negative-pressure zone V continues to be present around the imaginary center line 25*c* of the fluid rotating chamber 25 in a stable manner, with both ends thereof being stably positioned near a respective one of the spouts 28*a* and 28*b* and the gas introducing port 26.

As described above, with the gas introducing port 26 projecting inwardly toward the inside of the fluid rotating chamber 25 and the concave surface 21 provided, it is possible to prevent the end portion of the negative-pressure zone V on the side of the gas introducing port 26 from moving irregularly. Accordingly, no cavitation erosion or the like is caused on the partition walls 25*a* and 25*b* of the fluid rotating chamber 25, providing excellent durability. Furthermore, as shown in FIGS. 4 and 5, in a region close to the partition wall 25*b* of the fluid rotating chamber 25, an auxiliary rotating section 25*p* having a diameter larger than the diameter of the other areas is provided. By this structure, the water W introduced from the liquid introducing port 27 is once rectified in the auxiliary rotating section 25*p* and then introduced to the whole area in the fluid rotating chamber 25. Accordingly, pressure fluctuation of the water W introduced from the liquid introducing port 27 is buffered, which hinders the negative-pressure zone V from moving due to the pressure fluctuation, leading to effective prevention of cavitation erosion.

The above embodiment describes a use in which water and air are supplied to the fine-bubble generator 11 submerged in water to supply water mixed with the fine bubbles NB into the water. However, it should be noted that this is an example, and the present invention is not limited to the embodiment. The fine-bubble generator 11 may be submerged in any liquid other than water, and a liquid other than water and a gas other than air may be supplied to the fine-bubble generator 11 to produce fine bubbles. It is also possible to close the gas introducing passages 14*a* and 14*b* of the fine-bubble generator 11 and to supply only a liquid from the liquid introducing passages 18*a* and 18*b* to the fluid rotating chamber 25 or to supply a gas-liquid mixture from the liquid introducing passages 18*a* and 18*b* to the fluid rotating chamber 25.

Figure 8:
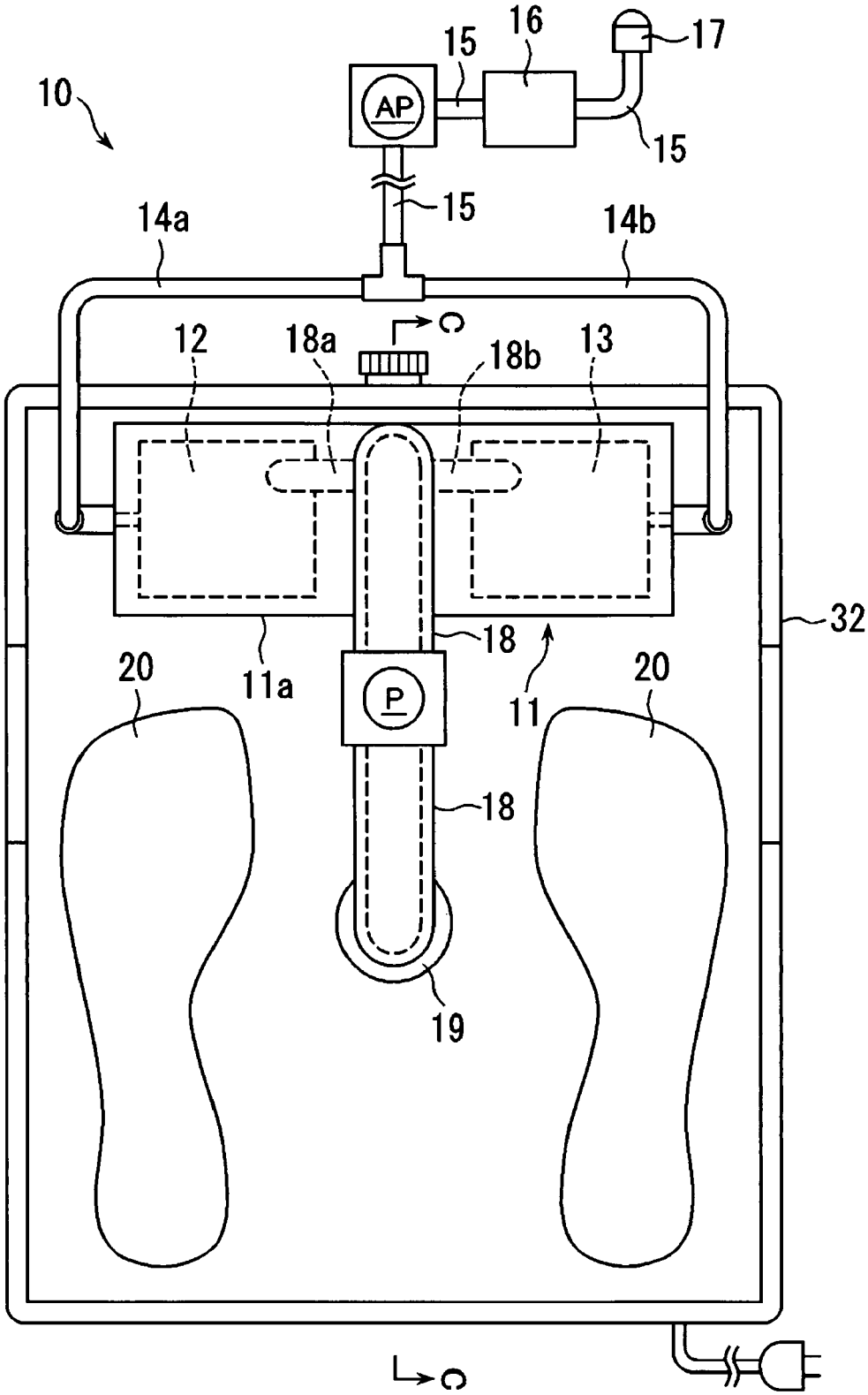
FIG. 8 is a plan view illustrating a foot-bathing apparatus of an embodiment of the present invention.
Figure 9:
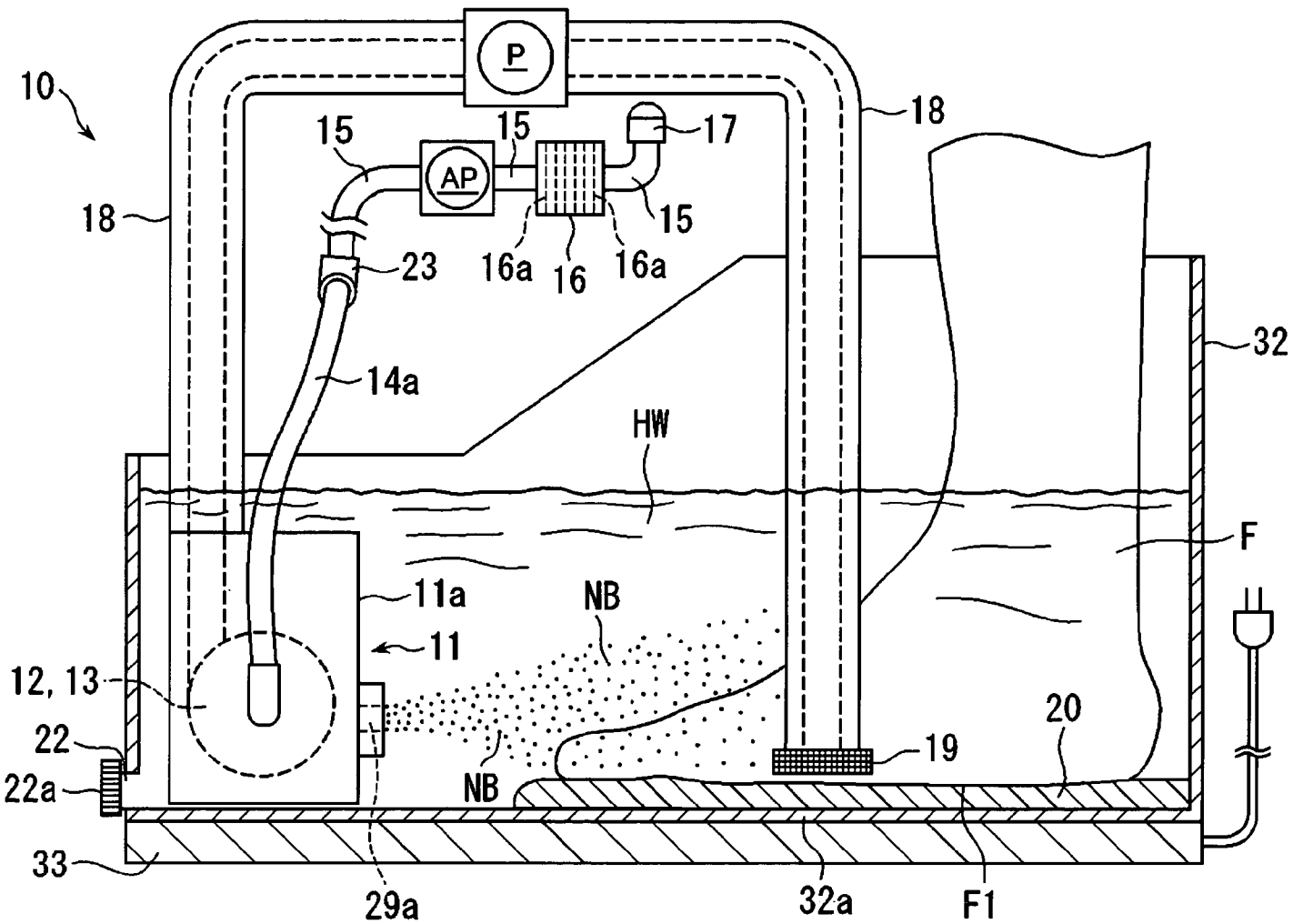
FIG. 9 is a sectional view taken along the line C-C in FIG. 8.

Next, referring to FIGS. 8 to 18, a foot-bathing apparatus of an embodiment of the present invention is explained below. FIG. 8 is a plan view illustrating a foot-bathing apparatus of an embodiment of the present invention; FIG. 9 is a sectional view taken along the line C-C in FIG. 8; and FIGS. 10 to 18 are plan views illustrating other embodiments relating to arrangements of the two fine-bubble generating sections. In FIGS. 8 to 18, the members assigned the same reference numerals as the reference numerals used in FIGS. 1 to 7 have the same structures, functions and effects as those of the components of the fine-bubble generator 11, and thus the explanation is omitted.

As shown in FIGS. 8 and 9, a foot-bathing apparatus 10 of the present embodiment is provided with a foot-bathing vessel 32 having a capacity which can accommodate at least a body extremity part below the ankle (referred to as a foot F hereunder), the fine-bubble generator 11 submerged in hot water HW contained in the foot-bathing vessel 32, a pump P for circulating and supplying the hot water HW in the foot-bathing vessel 32 via the liquid introducing passage 18 to the fine-bubble generating sections 12 and 13 constituting the fine-bubble generator 11, and the gas introducing passages 14*a*, 14*b* and 15 for supplying a gas to the fine-bubble generating sections 12 and 13. In the gas introducing passage 15, an air pump AP, an oxygen enriching device 16, and a filter 17 for filtering a gas are disposed. At a suction port of the liquid introducing passage 18, a filter 19 is mounted for filtering a liquid.

On a top surface of a bottom plate 32*a* of the foot-bathing vessel 32, a cushion material 20 is mounted to provide comfortable touch when a sole portion F1 is placed thereon. On a bottom surface of the bottom plate 32*a*, an electrothermal heating element 33 is disposed for heating the hot water HW in the foot-bathing vessel 32 and retaining its temperature. In a front side portion of the foot-bathing vessel 32, a drain 22 with an open/close cap 22*a* is provided to be used for draining the hot water HW from the foot-bathing vessel 32.

The gas introducing passage 15 is divided into the two gas introducing passages 14*a* and 14*b* with the branching member 23. With the function of the air pump AP, air in the atmosphere is sucked from the filter 17, passed through the oxygen enriching device 16 to enrich the air with oxygen, and supplied to the fine-bubble generating sections 12 and 13 via the gas introducing passages 14*a* and 14*b*, respectively. With the function of the pump P disposed in the liquid introducing passage 18, the hot water HW in the foot-bathing vessel 32 sucked through the filter 19 is supplied to the fine-bubble generating sections 12 and 13 through the liquid introducing passages 18, 18*a* and 18*b*.

The two fine-bubble generating sections 12 and 13 are disposed in the substantially rectangular parallelepiped casing 11*a* which is submerged in the hot water HW in the foot-bathing vessel 32. As shown in FIG. 5, these fine-bubble generating sections 12 and 13 are disposed in the casing 11*a* so that the spouts 28*a* and 28*b* are arranged to face each other in alignment with each other. The structure and function of the fine-bubble generating sections 12 and 13 are as described referring to FIGS. 1 to 7.

In the state illustrated in FIGS. 8 and 9, by operating the pump P and the air pump AP, the hot water HW which is sucked from the inside of the foot-bathing vessel 32 through the liquid introducing passage 18 flows into the fine-bubble generating sections 12 and 13 via the liquid introducing passages 18*a* and 18*b*. At the same time, with a feeding force of the air pump AP, air which is sucked from the atmosphere through the gas introducing passages 15, 14*a* and 14*b* flows into the fine-bubble generating sections 12 and 13, thereby forming the rotational flow R in each of the fluid rotating chambers 25 (see FIG. 6). Then, the hot water HW mixed with the fine bubbles NB is discharged from the discharge port 29*a* into the hot water HW in the foot-bathing vessel 32.

By discharging the hot water HW mixed with the fine bubbles NB from the discharge port 29*a* into the hot water HW as described above, oxygen, nitrogen or the like can be supplied to the hot water HW contained in the foot-bathing vessel 32 and dissolved therein. The hot water HW mixed with the fine bubbles NB is discharged between the two feet F which are inserted into the foot-bathing vessel 32 and placed on the cushion material 20 and circulates in the foot-bathing vessel 32 with the hot water HW. Therefore, the hot water HW containing a high amount of dissolved gases such as oxygen keeps evenly circulating over a whole area in the foot-bathing vessel 32, which provides a blood circulation enhancing effect, a heating effect, a sedating effect, and an autonomic nerve controlling effect to the foot F bathed in the hot water HW. The fluid mixed with the fine bubbles NB spouted from the spout 28 of the fine-bubble generating sections 12 and 13 to the mixing chamber 29 contains bubbles with an outer diameter larger than the fine bubbles NB. With these bubbles, it is also possible to obtain a massaging effect and a hot water circulating effect as in the conventional foot-bathing apparatus (foot-bathing vessel).

The above-described blood circulation enhancing effect, heating effect, sedating effect, and autonomic nerve controlling effect influence not only the foot F portion bathed in the hot water HW but also regions from an upper part of the foot F to a lumbar region. Therefore, it is possible to alleviate or eliminate pain in feet and a lumbar region such as arthritic pain or muscle pain. For this purpose, it is sufficient only to immerse the feet F in the hot water HW in the foot-bathing vessel 32 and to turn on the pump P and the air pump AP, which leads to an extremely easy use.

Additionally, it was observed that ultrasonic waves were generated around the discharge port 29*a* of the fine-bubble generator 11, which are presumably attributable to the fluid mixed with the fine bubbles NB swirling in the fine-bubble generating sections 12 and 13 as well as the cavitation. Thus, it is inferred that the ultrasonic waves may enhance blood circulation and contribute to the above-mentioned sedating effect and autonomic nerve controlling effect. It has also been confirmed that the fine-bubble generating sections 12 and 13 made of synthetic resin allow ultrasonic waves to more easily penetrate and have a tendency to generate stronger ultrasonic waves around the discharge port 29*a* compared to the fine-bubble generating sections 12 and 13 made of metal such as stainless steel. Therefore, by forming the fine-bubble generating sections 12 and 13 from synthetic resin, the ultrasonic waves generated in the fine-bubble generating sections 12 and 13 are radiated into the hot water HW in the foot-bathing vessel 32 in an efficient manner. Incidentally, the fine-bubble generating sections 12 and 13 may be made of ceramics.

In the present embodiment, with the oxygen enriching device 16 provided in the gas introducing passage 15, air in which the oxygen concentration has been increased by passing the air through the oxygen enriching device 16 can be supplied to the fluid rotating chamber 25. Accordingly, it is possible to spout the liquid mixed with a large quantity of the fine bubbles NB containing the air with a higher oxygen concentration than the oxygen concentration in the atmosphere into the hot water HW from the spouts 28*a* and 28*b* via the discharge port 29*a*. In this manner, the dissolved oxygen contained in the hot water HW in the foot-bathing vessel 32 and the oxygen concentration in an upper part of the foot-bathing vessel 32 are increased, providing a sedating effect and refreshing feelings.

The oxygen enriching device 16 houses therein a plurality of oxygen enriching membranes 16*a* made of an organic polymer compound. The passage time of molecular nitrogen which passes through the oxygen enriching membranes 16*a* is longer than the passage time of oxygen. Therefore, by passing air sucked from the atmosphere through the oxygen enriching membranes 16*a*, air containing a higher ratio of oxygen than in the atmosphere is generated (because it takes longer for nitrogen to pass through the membranes). In general, the ratio of oxygen to nitrogen in air in the atmosphere is 21% to 79%. In the air after passing through the oxygen enriching device 16, the ratio becomes 30% of oxygen to 70% of nitrogen, showing an increased ratio of the oxygen content.

In the gas introducing passage 15, the air pump AP is mounted to feed air into the fluid rotating chamber 25 with pressure. Thus, even when the fine-bubble generator 11 is positioned in a region of a higher water pressure for the reason of the depth of the foot-bathing vessel 32, for example, or even when the resistance generated in air passing through the oxygen enriching device 16 is large, air can be securely supplied into the liquid rotating chamber 25. Consequently, the liquid mixed with the fine bubbles NB can be spouted into the hot water HW in the foot-bathing vessel 32 in a stable manner.

In the fine-bubble generator 11 constituting the foot-bathing apparatus 10, as shown in FIG. 5, the two fine-bubble generating sections 12 and 13 are arranged to be opposite to each other so that the imaginary center lines 25*c* of the fluid rotating chambers 25 form an angle of 180 degrees, and the branching tubes 18*a* and 18*b* are arranged so that the rotational flows R generated in the fluid rotating chambers 25 of the fine-bubble generating sections 12 and 13 rotate in the same direction. In other words, the fine-bubble generating sections 12 and 13 have a structure in which the center lines 25*c* are positioned in alignment with each other, and the rotating directions of the rotational flows R generated in the fluid rotating chambers 25 correspond with each other. Accordingly, as apparent from the examination results mentioned later, an excellent pain-relieving effect can be obtained.

There are quite a few unclear points on the reason why the above arrangement leads to an excellent pain-relieving effect. Nevertheless, it can be inferred that, since the rotating directions of the fluids mixed with the fine bubbles NB spouted to face each other from the spouts 28*a* and 28*b* of the fine-bubble generating sections 12 and 13 are the same and, at the same time, the center lines 25*c* which are also the center lines of the rotational flows R are positioned in alignment with each other, the above-described function may be further improved by the synergetic effect.

The arrangement of the foot-bathing apparatus of the present invention is not limited to the above position. The positioning of either of the liquid introducing passages 18*a* and 18*b* in relation to the fluid rotating chamber 25 may be varied so that the rotating directions of the rotational flows R in the fine-bubble generating sections 12 and 13 become opposite. It is further possible to have a structure in which a switching valve is provided in a connecting portion between the liquid introducing passages 18, 18*a* and 18*b* to change a supply rate of the hot water HW to be supplied to the fine-bubble generating sections 12 and 13 or to supply the hot water HW only to one of the fine-bubble generating sections 12 and 13. Similarly, it is possible to have a structure in which a switching valve is provided in a connecting portion between a gas introducing passage 15 and the gas introducing passages 14*a* and 14*b* to change a supply rate of air to be supplied to the fine-bubble generating sections 12 and 13 or to supply air only to one of the fine-bubble generating sections 12 and 13.

In the foot-bathing apparatus 10, the electrothermal heating element 33 is disposed on the bottom surface of the bottom plate 32*a* of the foot-bathing vessel 32. Therefore, the temperature of the hot water HW in the foot-bathing vessel 32 can be retained at a predetermined constant temperature. Thus, even when the foot-bathing apparatus 10 is used for a long time, the temperature of the hot water HW does not drop. Here, the liquid to be contained in the foot-bathing vessel 32 is not limited to the hot water HW, and cold water or other liquids can be contained to provide a foot bath.

The shape of the foot-bathing vessel 32 is not particularly limited and can be deeper or wider depending on the condition of use. In the present embodiment, the fine-bubble generator 11 is arranged so that the imaginary center lines 25*c* of the fluid rotating chambers 25 of the fine-bubble generating sections 12 and 13 are horizontal. However, the arrangement is not limited to this posture, and the fine-bubble generator 11 may be arranged so that the imaginary center lines 25*c* are vertical or slanted depending on the shape of the foot-bathing vessel 32 or the user's desire. Furthermore, while the method of use described in the present embodiment is to immerse the foot F in the hot water HW in the foot-bathing vessel 32, the method of using the foot-bathing apparatus 10 is not limited to this. A hand may be immersed in the hot water HW in the foot-bathing vessel 32, which exhibits an effect similar to the effect described above.

Here, changes in pain when using the foot-bathing apparatus 10 of the present embodiment in practice were examined with 23 subjects (A to W) suffering various kinds of pain in their upper or lower limbs. The results are explained below based on Table 1. In the fine-bubble generator 11, as described above, the plurality of fine-bubble generating sections 12 and 13 are arranged to be opposite to each other so that the imaginary center lines 25*c* of the fluid rotating chambers 25 form an angle of 180 degrees, and the liquid introducing passages 18*a* and 18*b* are positioned so that the rotational flows R generated in the fluid rotating chambers 25 of the plurality of fine-bubble generating sections 12 and 13 rotate in the same direction. Namely, the center lines 25*c* are positioned in alignment with each other, and the rotating directions of the rotational flows R generated in the fluid rotating chamber 25 correspond to each other.

The subjects (A to W) immersed their feet or hands suffering pain in the hot water HW contained in the foot-bathing vessel 32 of the foot-bathing apparatus 10 with the fine-bubble generator 11 in operation for a certain period (25 minutes). Then, the degrees of pain of the subjects after the 25 minutes' immersion were expressed in numerical values from 1 to 10 in relation to the degrees of pain before the immersion noted as 10. The results obtained are shown in Table 1 below.

TABLE 1

| Subject | Immersed part | Period of immersion | Condition | Change in pain |
|---|---|---|---|---|
| A | foot | 25 minutes | pain in left foot | 10 to 2 |
| B | foot | 25 minutes | pain in left foot | 10 to 4 |
| C | foot | 25 minutes | pain in left foot | 10 to 5 |
| D | foot | 25 minutes | pain in both lower limbs | 10 to 6 |
| E | hand | 25 minutes | pain in both hands | 10 to 5 |
| F | foot | 25 minutes | pain in left lower limb | 10 to 2 |
| G | foot | 25 minutes | pain in right lower limb | 10 to 8 |
| H | foot | 25 minutes | pain in both feet | 10 to 5 |
| I | foot | 25 minutes | pain in both feet | 10 to 4 |
| J | foot | 25 minutes | pain in left lower limb | 10 to 4 |
| K | foot | 25 minutes | pain in left lower limb | 10 to 7 |
| L | hand | 25 minutes | pain in both hands | 10 to 2 |
| M | hand | 25 minutes | pain in both hands | 10 to 1 |
| N | foot | 25 minutes | pain in right lower limb | 10 to 4 |
| O | hand | 25 minutes | pain in both hands | 10 to 4 |
| P | foot | 25 minutes | pain in both lower limbs | 10 to 6 |
| Q | foot | 25 minutes | pain in both lower limbs | 10 to 4 |
| R | foot | 25 minutes | pain in both lower limbs | 10 to 7 |
| S | foot | 25 minutes | pain in right lower limb | 10 to 3 |
| T | foot | 25 minutes | pain in both feet | 10 to 3 |
| U | foot | 25 minutes | pain in both feet | 10 to 5 |

TABLE 1-continued

| Subject | Immersed part | Period of immersion | Condition | Change in pain |
|---|---|---|---|---|
| V | foot | 25 minutes | pain in right foot | 10 to 4 |
| W | foot | 25 minutes | pain in both feet | 10 to 3 |

Average change in pain: 10 to 4.26

In the fluid rotating chamber 25 of the fine-bubble generating section 12 constituting the foot-bathing apparatus 10, as shown in FIG. 6, the rotational flow R is generated left-handed whereas, in the fluid rotating chamber 25 of the fine-bubble generating section 13, the rotational flow R is generated right-handed. Here, regarding the terms "right-handed" and "left-handed", on the basis of the viewpoints from the insides of the fine-bubble generating sections 12 and 13 toward the spouts 28*a* and 28*b*, a clockwise motion is referred to as being right-handed while a counterclockwise motion referred to as being left-handed (the expressions used below mean the same). As seen from Table 1, the pain of the subjects was mitigated by immersing their feet or hands in the hot water HW in the foot-bathing vessel 32 of the foot-bathing apparatus 10 depending on the conditions of the subjects. The calculated average of the "change in pain" resulted in "10 to 4.26". From the results, it has been proved that the use of the foot-bathing apparatus 10 leads to considerable relief of pain in the feet and hands.

Next, as a comparison of the foot-bathing apparatus 10 provided with the fine-bubble generator 11 having the two fine-bubble generating sections 12 and 13, another foot-bathing apparatus (not shown) having a structure that the fine-bubble generating section 12 is solely disposed in the hot water HW in a foot-bathing vessel was examined under the same conditions. Specifically, 23 subjects (A to W) who suffer various pain in their feet or hands used the foot-bathing apparatus (not shown) with only the fine-bubble generating section 12 submerged in the hot water HW in the foot-bathing vessel under the same conditions, and the changes in pain were investigated. In this case, in the fluid rotating chamber 25 of the fine-bubble generating section 12, the rotational flow R is generated left-handed. Then, the degrees of pain of the subjects after the 25 minutes' immersion in hot water in the foot-bathing vessel in the above foot-bathing apparatus were expressed in numerical values from 1 to 10 in relation to the degrees of pain before the immersion noted as 10. The results obtained are shown in Table 2.

TABLE 2

| Subject | Immersed part | Period of immersion | Condition | Change in pain |
|---|---|---|---|---|
| A | foot | 25 minutes | pain in left foot | 10 to 5 |
| B | foot | 25 minutes | pain in left foot | 10 to 5 |
| C | foot | 25 minutes | pain in left foot | 10 to 8 |
| D | foot | 25 minutes | pain in both lower limbs | 10 to 7 |
| E | hand | 25 minutes | pain in both hands | 10 to 5 |
| F | foot | 25 minutes | pain in left lower limb | 10 to 4 |
| G | foot | 25 minutes | pain in right lower limb | 10 to 5 |
| H | foot | 25 minutes | pain in both feet | 10 to 7 |
| I | foot | 25 minutes | pain in both feet | 10 to 7.5 |
| J | foot | 25 minutes | pain in left lower limb | 10 to 5 |
| K | foot | 25 minutes | pain in left lower limb | 10 to 10 |
| L | hand | 25 minutes | pain in both hands | 10 to 7 |
| M | hand | 25 minutes | pain in both hands | 10 to 5 |
| N | foot | 25 minutes | pain in right lower limb | 10 to 1 |
| O | hand | 25 minutes | pain in both hands | 10 to 4 |
| P | foot | 25 minutes | pain in both lower limbs | 10 to 7.5 |
| Q | foot | 25 minutes | pain in both lower limbs | 10 to 8 |
| R | foot | 25 minutes | pain in both lower limbs | 10 to 10 |
| S | foot | 25 minutes | pain in right lower limb | 10 to 3 |

TABLE 2-continued

| Subject | Immersed part | Period of immersion | Condition | Change in pain |
|---|---|---|---|---|
| T | foot | 25 minutes | pain in both feet | 10 to 6 |
| U | foot | 25 minutes | pain in both feet | 10 to 7 |
| V | foot | 25 minutes | pain in right foot | 10 to 7 |
| W | foot | 25 minutes | pain in both feet | 10 to 6 |

Average change in pain: 10 to 6.09

Referring to the Table 2, it is seen that, except the subjects K and R, the pain of the subjects was somewhat lessened by immersing their feet or hands in the hot water in the foot-bathing vessel of the above foot-bathing apparatus provided with only the fine-bubble generating section 12 for a certain amount of time depending on the conditions of the subjects. However, the average change in pain turned out to be "10 to 6.09", which is less than the change in the case of the foot-bathing apparatus 10. From the results, it has been proved that the foot-bathing apparatus 10 provided with the two fine-bubble generating sections 12 and 13 arranged to be opposite to each other has a higher pain-relieving effect on the feet and hands compared to the foot-bathing apparatus solely with the fine-bubble generating section 12.

Next, with reference to FIGS. 10 to 18, when the positional relationship between the two fine-bubble generating sections 12 and 13 is changed, the difference in the pain-relieving effects on the 10 subjects (A to J) suffering various pain in their lower limbs is explained below. FIGS. 10 to 18 are plan views illustrating other embodiments relating to arrangements of the two fine-bubble generating sections 12 and 13. The fine-bubble generating sections 12 and 13 described in these drawings have the same structures as the fine-bubble generating sections 12 and 13 shown in FIGS. 1 to 6.

The subjects (A to J) immersed their feet suffering pain for a certain period (25 minutes) in hot water in a foot-bathing vessel of a foot-bathing apparatus (not shown) with the two fine-bubble generating sections 12 and 13 in operation which were arranged in the states shown in FIGS. 10 to 18. Then, the degrees of pain of the subjects after the 25 minutes' immersion were expressed in numerical values from 1 to 10 in relation to the degrees of pain before the immersion noted as 10. The results obtained are shown in Tables 3 to 11 below.

Figure 10:
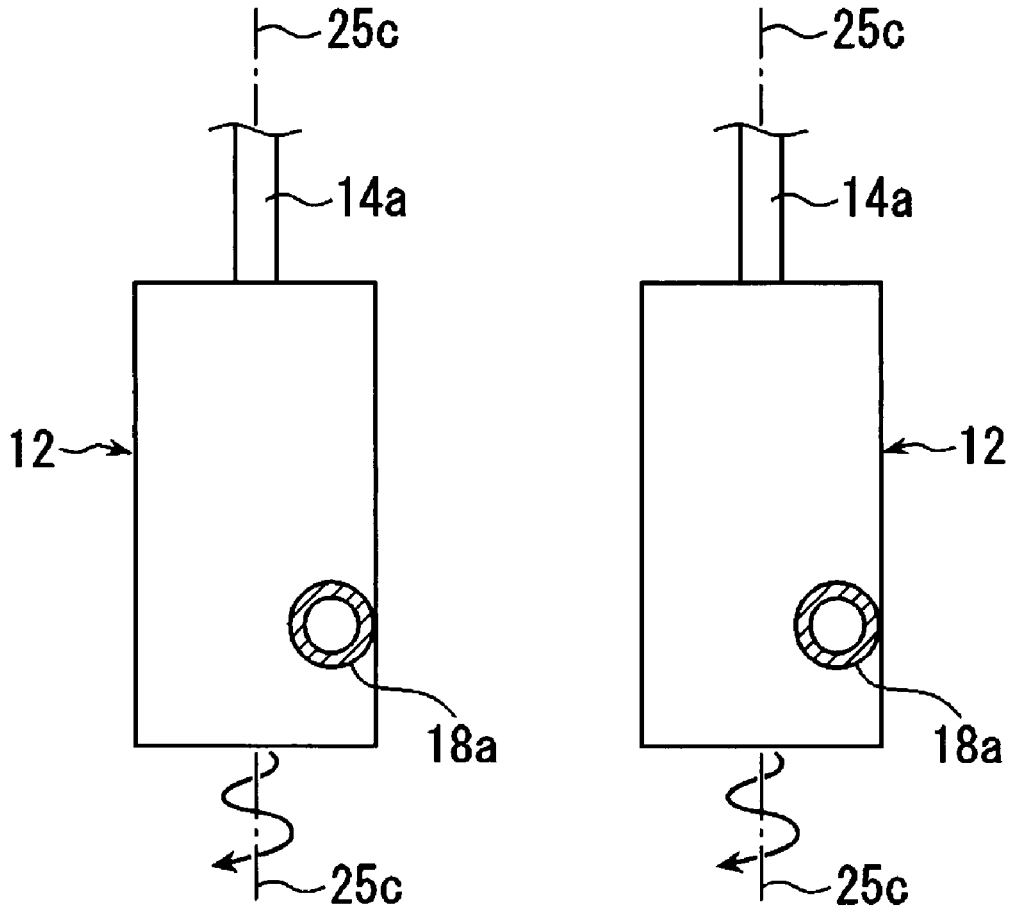
FIG. 10 is a plan view illustrating another embodiment relating to an arrangement of two fine-bubble generating sections.

In an embodiment shown in FIG. 10, two of the fine-bubble generating sections 12 are arranged so that the center lines 25*c* of the fluid rotating chambers 25 (see FIGS. 5 and 6) are positioned in parallel to each other. Fluids mixed with the fine bubbles NB are spouted from the spouts 28*a* of the fine-bubble generating sections 12 while rotating left-handed. When the subjects (A to J) used the foot-bathing apparatus with the above arrangement, the pain-relieving effects were examined. The results obtained are shown in Table 3. From Table 3, it is seen that the "average change in pain" is "10 to 6.45", that is, the pain of the subjects by using the foot-bathing apparatus with the arrangement shown in FIG. 10 was lessened whereas the pain-relieving effects using the foot-bathing apparatus 10 shown in FIGS. 8 and 9 were far superior.

| Subject | Immersed part | Period of immersion | Condition | Change in pain |
|---|---|---|---|---|
| A | foot | 25 minutes | pain in left foot | 10 to 4 |
| B | foot | 25 minutes | pain in left foot | 10 to 7 |
| C | foot | 25 minutes | pain in right foot | 10 to 8 |
| D | foot | 25 minutes | pain in both feet | 10 to 5.5 |
| E | foot | 25 minutes | pain in right foot | 10 to 4 |

-continued

| Subject | Immersed part | Period of immersion | Condition | Change in pain |
|---|---|---|---|---|
| F | foot | 25 minutes | pain in left lower limb | 10 to 8 |
| G | foot | 25 minutes | pain in both feet | 10 to 7 |
| H | foot | 25 minutes | pain in both feet | 10 to 8 |
| I | foot | 25 minutes | pain in right foot | 10 to 8 |
| J | foot | 25 minutes | pain in right foot | 10 to 5 |

Average change in pain: 10 to 6.45

Figure 11:
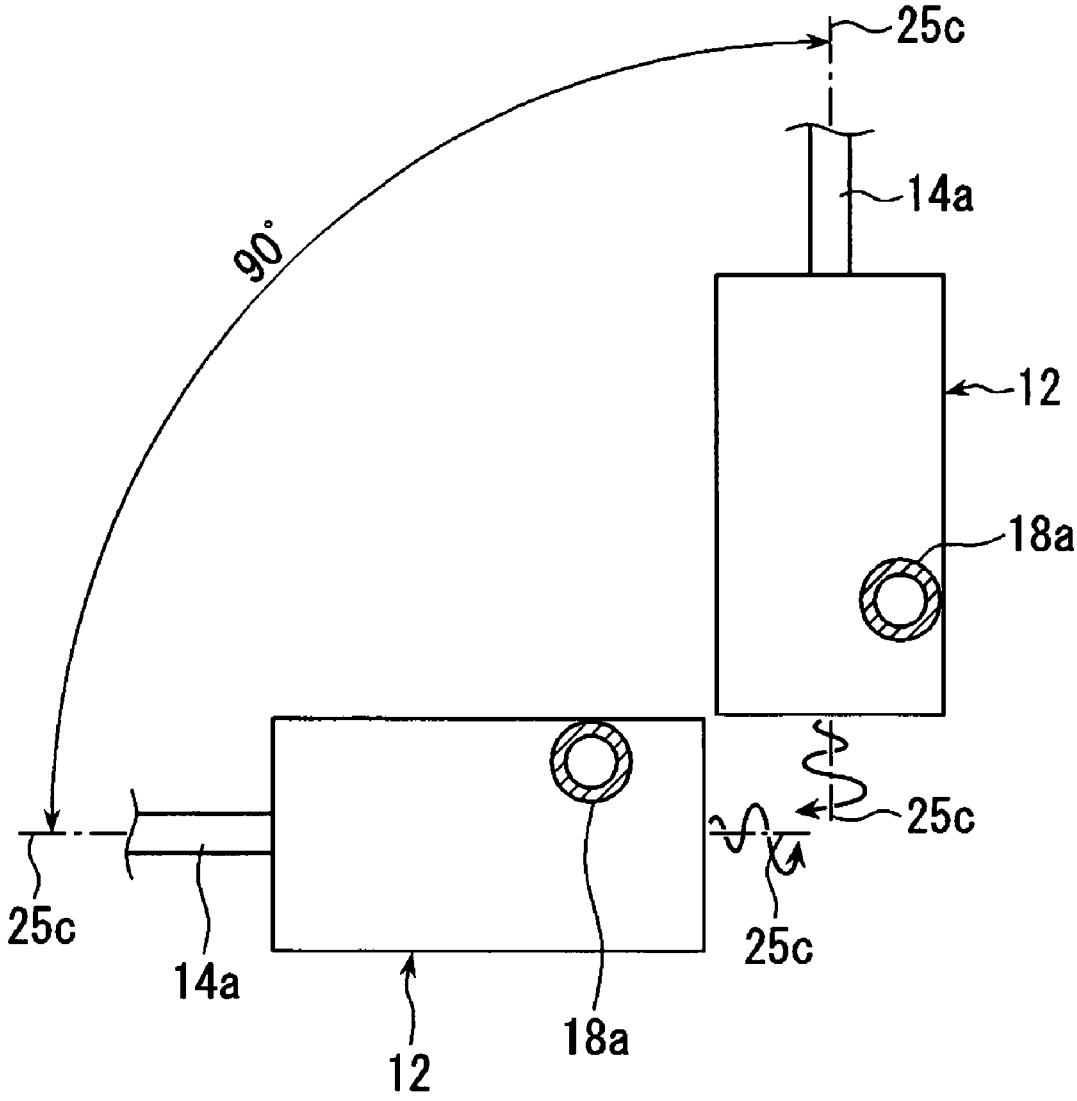
FIG. 11 is a plan view illustrating yet another embodiment relating to an arrangement of two fine-bubble generating sections.

In an embodiment shown in FIG. 11, two of the fine-bubble generating sections 12 are arranged so that the center lines 25*c* of the fluid rotating chambers 25 (see FIGS. 5 and 6) are vertically positioned. Fluids mixed with the fine bubbles NB are spouted from the spouts 28*a* of the two fine-bubble generating sections 12 while rotating left-handed. When the subjects (A to J) used the foot-bathing apparatus with the above arrangement, the pain-relieving effects were examined. The results obtained are shown in Table 4. From Table 4, it is seen that the "average change in pain" is "10 to 6.35", that is, the pain of the subjects by using the foot-bathing apparatus with the arrangement shown in FIG. 11 was lessened as in the previous case; however, the pain-relieving effects using the foot-bathing apparatus 10 shown in FIGS. 8 and 9 were greater.

TABLE 4

| Subject | Immersed part | Period of immersion | Condition | Change in pain |
|---|---|---|---|---|
| A | foot | 25 minutes | pain in left foot | 10 to 9 |
| B | foot | 25 minutes | pain in right foot | 10 to 4 |
| C | foot | 25 minutes | pain in right foot | 10 to 6 |
| D | foot | 25 minutes | pain in right lower limb | 10 to 5 |
| E | foot | 25 minutes | pain in left lower limb | 10 to 8 |
| F | foot | 25 minutes | pain in both feet | 10 to 6.5 |
| G | foot | 25 minutes | pain in both feet | 10 to 6 |
| H | foot | 25 minutes | pain in left foot | 10 to 4 |
| I | foot | 25 minutes | pain in left foot | 10 to 8 |
| J | foot | 25 minutes | pain in right foot | 10 to 7 |

Average change in pain: 10 to 6.35

Figure 12:
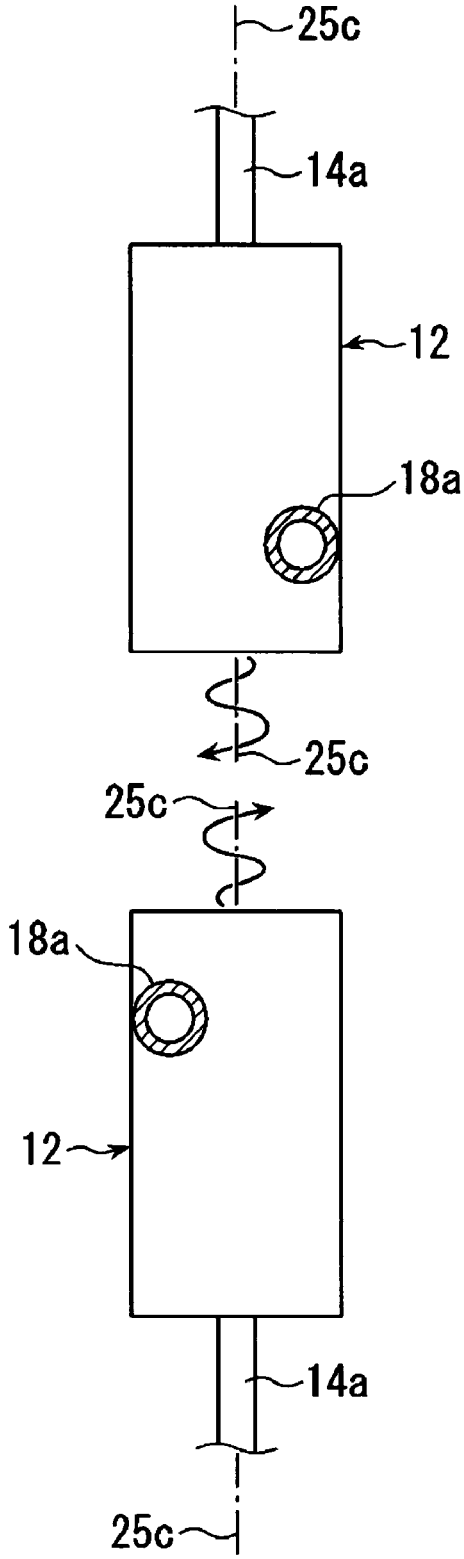
FIG. 12 is a plan view illustrating yet another embodiment relating to an arrangement of two fine-bubble generating sections.

Next, in an embodiment shown in FIG. 12, two of the fine-bubble generating sections 12 are arranged so that the center lines 25*c* of the fluid rotating chambers 25 (see FIGS. 5 and 6) form an angle of 180 degrees or are positioned in alignment with each other. Fluids mixed with the fine bubble NB are spouted from the spouts 28*a* of the two fine-bubble generating sections 12 while rotating left-handed. When the subjects (A to J) used the foot-bathing apparatus with the above arrangement, the pain-relieving effects were examined. The results obtained are shown in Table 5. As shown in Table 5, the "average change in pain" was "10 to 6.5", that is, the pain of the subjects was lessened by using the foot-bathing apparatus with the arrangement shown in FIG. 12 although the effects were inferior to the pain-relieving effects when using the foot-bathing apparatus 10 shown in FIGS. 8 and 9. In the present embodiment, it is inferred that, although the two fine-bubble generating sections 12 are arranged so that the center lines 25*c* of the fluid rotating chambers 25 (see FIG. 6) form an angle of 180 degrees, sufficient pain-relieving effect may not have been obtained due to the different rotating directions of the rotational flows R (see FIG. 6) in the two fine-bubble generating sections 12.

TABLE 5

| Subject | Immersed part | Period of immersion | Condition | Change in pain |
|---|---|---|---|---|
| A | foot | 25 minutes | pain in right foot | 10 to 7 |
| B | foot | 25 minutes | pain in right foot | 10 to 8 |
| C | foot | 25 minutes | pain in both feet | 10 to 8 |
| D | foot | 25 minutes | pain in right lower limb | 10 to 5 |
| E | foot | 25 minutes | pain in left lower limb | 10 to 6 |
| F | foot | 25 minutes | pain in left foot | 10 to 5 |
| G | foot | 25 minutes | pain in both lower limbs | 10 to 5 |
| H | foot | 25 minutes | pain in both feet | 10 to 6 |
| I | foot | 25 minutes | pain in both feet | 10 to 8 |
| J | foot | 25 minutes | pain in left foot | 10 to 7 |

Average change in pain: 10 to 6.5

Figure 13:
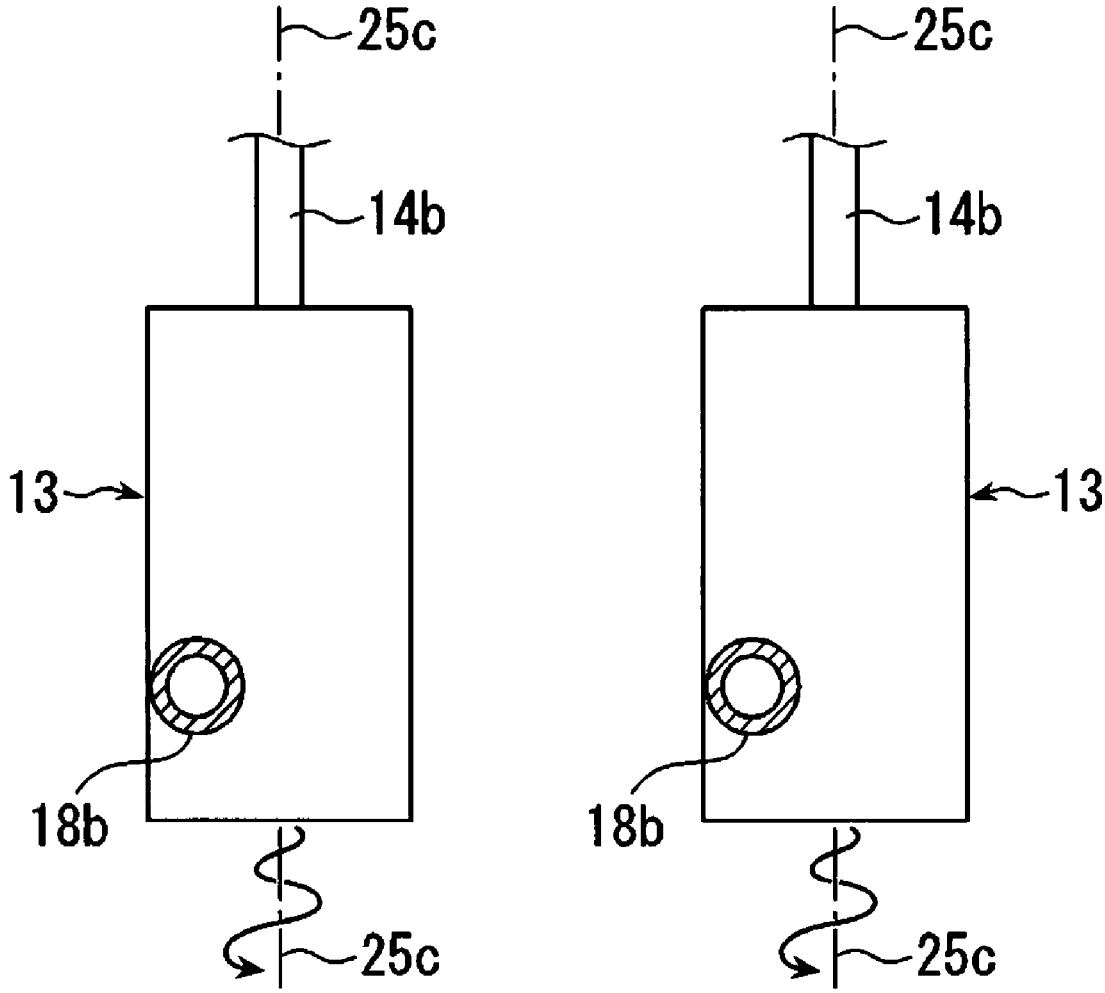
FIG. 13 is a plan view illustrating yet another embodiment relating to an arrangement of two fine-bubble generating sections.

Next, in an embodiment shown in FIG. 13, two of the fine-bubble generating sections 13 are arranged so that the center lines 25*c* of the fluid rotating chamber 25 (see FIGS. 5 and 6) are positioned in parallel to each other. Fluids mixed with the fine bubbles NB are spouted from the spouts 28*b* of the two fine-bubble generating sections 13 while rotating right-handed. When the subjects (A to J) used the foot-bathing apparatus with the above arrangement, the pain-relieving effects were examined. The results obtained are shown in Table 6. From Table 6, it is seen that the "average change in pain" is "10 to 6.4", that is, the pain of the subjects was lessened by using the foot-bathing apparatus with the arrangement shown in FIG. 13; however, the pain-relieving effects using the foot-bathing apparatus 10 shown in FIGS. 8 and 9 were still superior.

TABLE 6

| Subject | Immersed part | Period of immersion | Condition | Change in pain |
|---|---|---|---|---|
| A | foot | 25 minutes | pain in left foot | 10 to 5 |
| B | foot | 25 minutes | pain in left foot | 10 to 8 |
| C | foot | 25 minutes | pain in left lower limb | 10 to 8 |
| D | foot | 25 minutes | pain in both lower limb | 10 to 7 |
| E | foot | 25 minutes | pain in both lower limb | 10 to 4 |
| F | foot | 25 minutes | pain in left foot | 10 to 8 |
| G | foot | 25 minutes | pain in right foot | 10 to 5 |
| H | foot | 25 minutes | pain in right foot | 10 to 6 |
| I | foot | 25 minutes | pain in both feet | 10 to 7 |
| J | foot | 25 minutes | pain in both feet | 10 to 6 |

Average change in pain: 10 to 6.4

Figure 14:
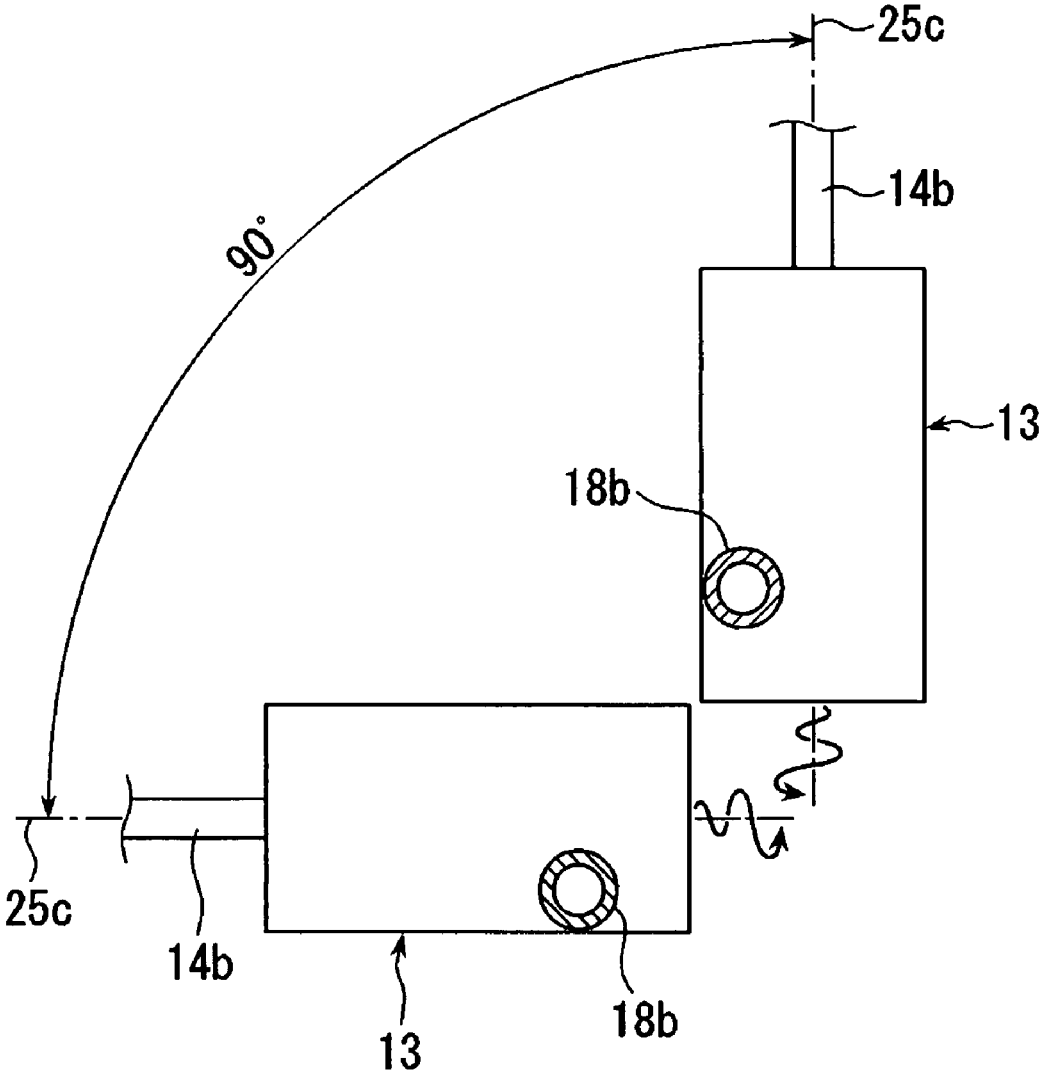
FIG. 14 is a plan view illustrating yet another embodiment relating to an arrangement of two fine-bubble generating sections.

Next, in an embodiment shown in FIG. 14, two of the fine-bubble generating sections 13 are arranged so that the center lines 25*c* of the fluid rotating chambers 25 (see FIGS. 5 and 6) are vertically positioned. Fluids mixed with the fine bubbles NB are spouted from the spouts 28*b* of the fine-bubble generating sections 13 while rotating right-handed. When the subjects (A to J) used the foot-bathing apparatus with the above arrangement, the pain-relieving effects were examined. The results obtained are shown in Table 7. From Table 7, it is seen that the "average change in pain" is "10 to 6.45" meaning some mitigation of the pain of the subjects by using the foot-bathing apparatus with the arrangement shown in FIG. 14, but the effects still did not reach the pain-relieving effects using the foot-bathing apparatus 10 shown in FIGS. 8 and 9.

TABLE 7

| Subject | Immersed part | Period of immersion | Condition | Change in pain |
|---|---|---|---|---|
| A | foot | 25 minutes | pain in right lower limb | 10 to 8 |
| B | foot | 25 minutes | pain in right lower limb | 10 to 7 |
| C | foot | 25 minutes | pain in right lower limb | 10 to 7 |
| D | foot | 25 minutes | pain in left lower limb | 10 to 6.5 |
| E | foot | 25 minutes | pain in left foot | 10 to 4 |
| F | foot | 25 minutes | pain in right foot | 10 to 8 |
| G | foot | 25 minutes | pain in both feet | 10 to 6.5 |
| H | foot | 25 minutes | pain in both feet | 10 to 5.5 |
| I | foot | 25 minutes | pain in left foot | 10 to 4 |
| J | foot | 25 minutes | pain in left foot | 10 to 8 |

Average change in pain: 10 to 6.45

Figure 15:
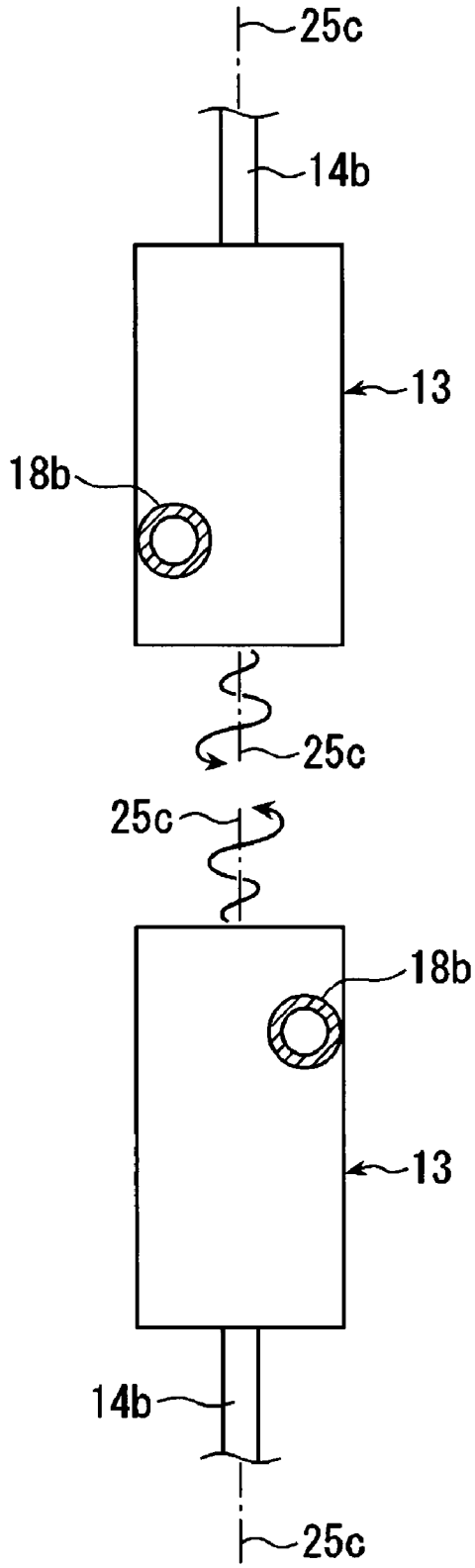
FIG. 15 is a plan view illustrating yet another embodiment relating to an arrangement of two fine-bubble generating sections.

Next, in an embodiment shown in FIG. 15, two of the fine-bubble generating sections 13 are arranged so that the center lines 25*c* of the fluid rotating chambers 25 (see FIGS. 5 and 6) form an angle of 180 degrees or are positioned in alignment with each other. Fluids mixed with the fine bubbles NB are spouted from the spouts 28*b* of the two fine-bubble generating sections 13 while rotating right-handed. When the subject (A to J) used the foot-bathing apparatus with the above arrangement, the pain-relieving effects were examined. The results obtained are shown in Table 8. From Table 8, it is seen that the "average change in pain" is "10 to 6.4" meaning some mitigation of the pain of the subjects by using the foot-bathing apparatus with the arrangement shown in FIG. 15 although the effects were still inferior to the pain-relieving effects when using the foot-bathing apparatus 10 shown in FIGS. 8 and 9. In the present embodiment, it is inferred that, although the two fine-bubble generating sections 13 are arranged so that the center lines 25*c* of the fluid rotating chambers 25 (see FIG. 6) form an angle of 180 degrees, sufficient pain-relieving effect may not have been obtained due to the different rotating directions of the rotational flows R (see FIG. 6) in the two fine-bubble generating sections 13 as with the embodiment shown in FIG. 12.

TABLE 8

| Subject | Immersed part | Period of immersion | Condition | Change in pain |
|---|---|---|---|---|
| A | foot | 25 minutes | pain in both feet | 10 to 8 |
| B | foot | 25 minutes | pain in left foot | 10 to 6 |
| C | foot | 25 minutes | pain in both lower limb | 10 to 6 |
| D | foot | 25 minutes | pain in right lower limb | 10 to 5 |
| E | foot | 25 minutes | pain in right lower limb | 10 to 4 |
| F | foot | 25 minutes | pain in right foot | 10 to 7 |
| G | foot | 25 minutes | pain in right foot | 10 to 8 |
| H | foot | 25 minutes | pain in both feet | 10 to 7 |
| I | foot | 25 minutes | pain in both feet | 10 to 8 |
| J | foot | 25 minutes | pain in left foot | 10 to 5 |

Average change in pain: 10 to 6.4

Figure 16:
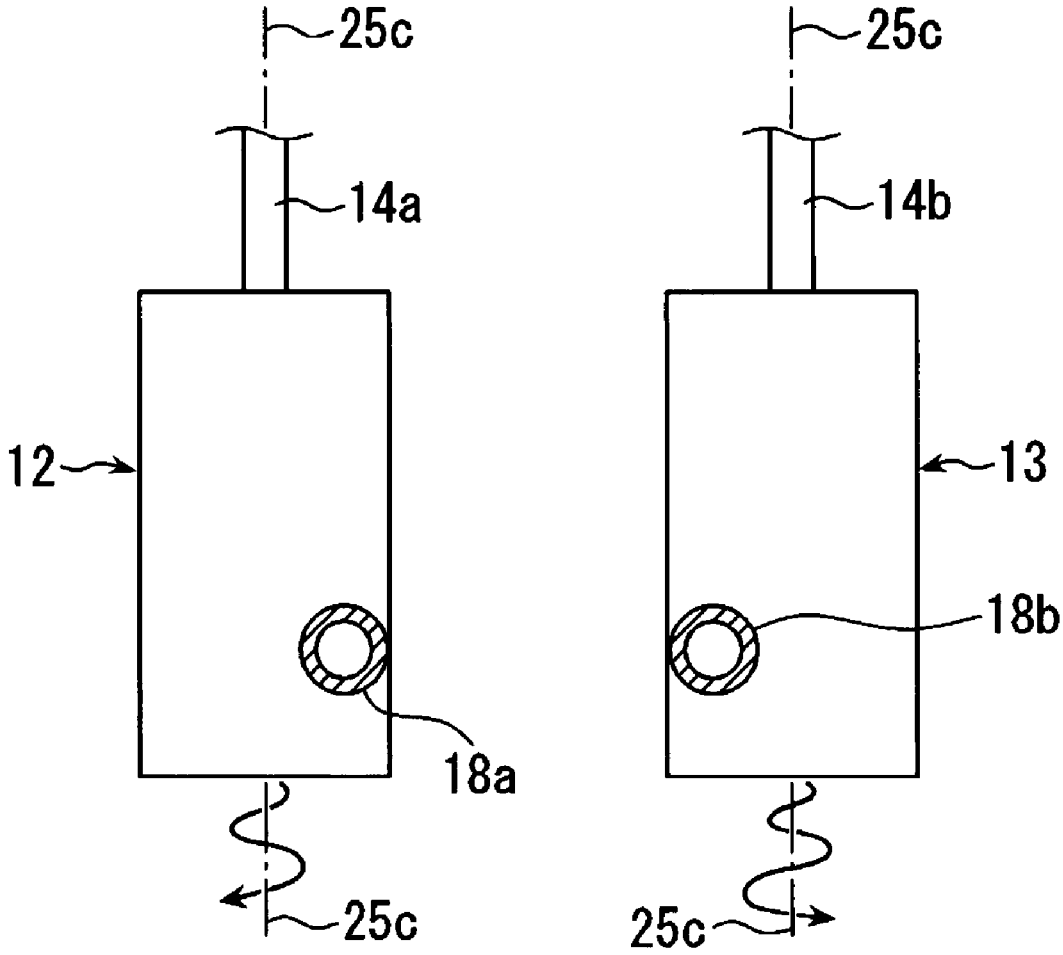
FIG. 16 is a plan view illustrating yet another embodiment relating to an arrangement of two fine-bubble generating sections.

Next, in an embodiment shown in FIG. 16, two of the fine-bubble generating sections 12 and 13 are arranged so that the center lines 25*c* of the fluid rotating chambers 25 (see FIGS. 5 and 6) are positioned in parallel to each other. As shown in FIG. 6, a fluid mixed with the fine bubbles NB is spouted from the spout 28*a* of the fine-bubble generating section 12 while rotating left-handed, and a fluid mixed with the fine bubbles NB is spouted from the spout 28*b* of the fine-bubble generating section 13 while rotating right-handed. When the subjects (A to J) used the foot-bathing apparatus with the above arrangement, the pain-relieving effects were examined. The results obtained are shown in Table 9. From Table 9, it is seen that the "average change in pain" is "10 to 6.8" meaning some mitigation of the pain of the subjects by using the foot-bathing apparatus with the arrangement shown in FIG. 16, but the effects did not reach the pain-relieving effects of the foot-bathing apparatus 10 shown in FIGS. 8 and 9.

TABLE 9

| Subject | Immersed part | Period of immersion | Condition | Change in pain |
|---|---|---|---|---|
| A | foot | 25 minutes | pain in both feet | 10 to 8 |
| B | foot | 25 minutes | pain in right lower limb | 10 to 10 |
| C | foot | 25 minutes | pain in right foot | 10 to 7 |
| D | foot | 25 minutes | pain in left foot | 10 to 6 |
| E | foot | 25 minutes | pain in left foot | 10 to 5 |
| F | foot | 25 minutes | pain in right foot | 10 to 8 |
| G | foot | 25 minutes | pain in right foot | 10 to 7 |
| H | foot | 25 minutes | pain in both feet | 10 to 6 |
| I | foot | 25 minutes | pain in both lower limbs | 10 to 7 |
| J | foot | 25 minutes | pain in left foot | 10 to 4 |

Average change in pain: 10 to 6.8

Figure 17:
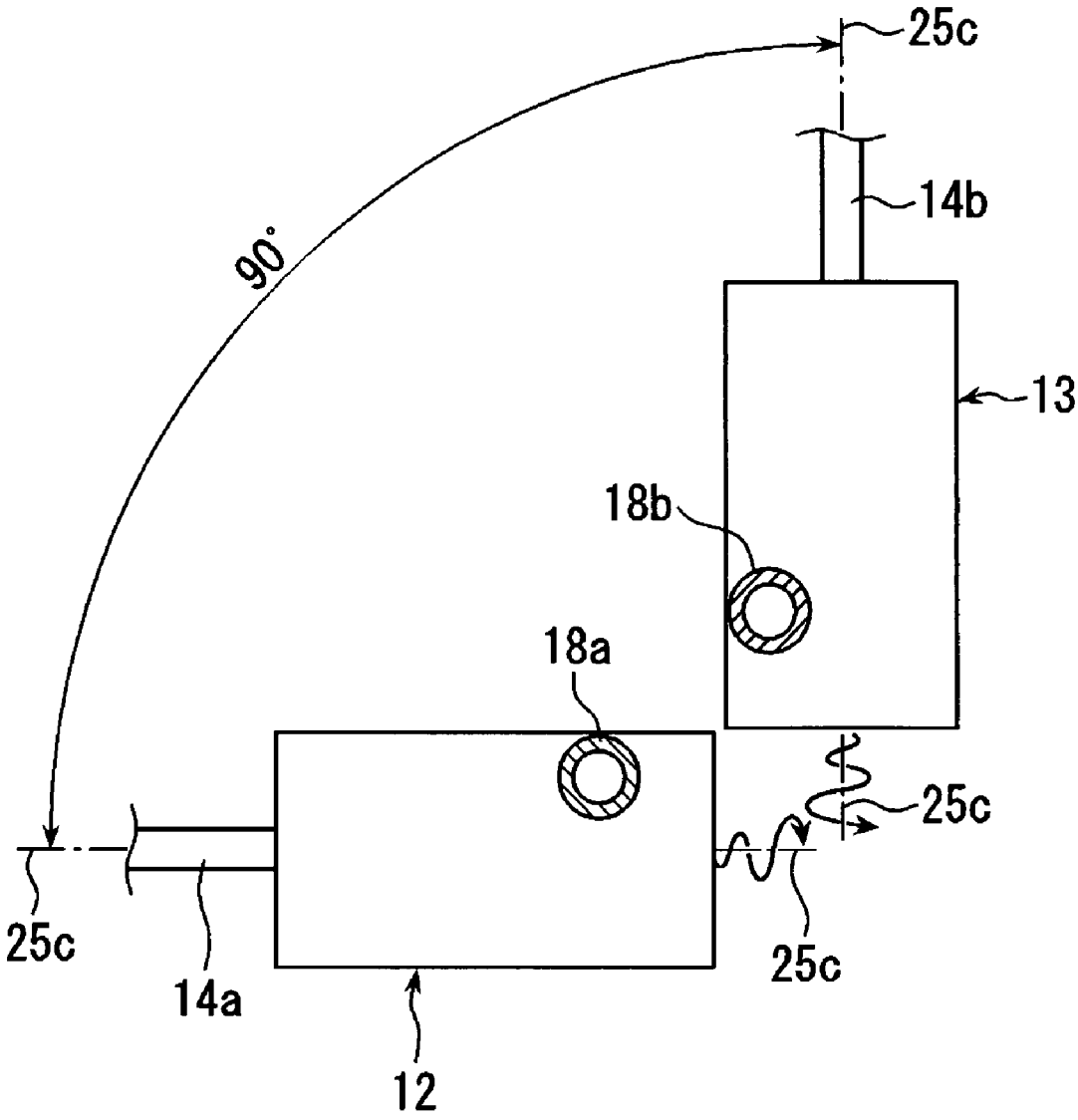
FIG. 17 is a plan view illustrating yet another embodiment relating to an arrangement of two fine-bubble generating sections.

Next, in an embodiment shown in FIG. 17, two of the fine-bubble generating sections 12 and 13 are arranged so that the center lines 25*c* of the fluid rotating chambers 25 (see FIGS. 5 and 6) are vertically positioned. A fluid mixed with the fine bubbles NB is spouted from the spout 28*a* of the fine-bubble generating section 12 while rotating left-handed, and a fluid mixed with the fine bubbles NB is spouted from the spout 28*b* of the fine-bubble generating section 13 while rotating right-handed. When the subjects (A to J) used the foot-bathing apparatus with the above arrangement, the pain-relieving effects were examined. The results obtained are shown in Table 10. From Table 10, it is seen that the "average change in pain" is "10 to 6.25" meaning some mitigation of the pain of the subjects by using the foot-bathing apparatus with the arrangement shown in FIG. 17; however, the effects still did not reach the pain-relieving effects of the foot-bathing apparatus 10 shown in FIGS. 8 and 9.

TABLE 10

| Subject | Immersed part | Period of immersion | Condition | Change in pain |
|---|---|---|---|---|
| A | foot | 25 minutes | pain in left foot | 10 to 7.5 |
| B | foot | 25 minutes | pain in left foot | 10 to 7 |
| C | foot | 25 minutes | pain in right foot | 10 to 6 |
| D | foot | 25 minutes | pain in left lower limb | 10 to 6 |
| E | foot | 25 minutes | pain in both lower limbs | 10 to 7 |
| F | foot | 25 minutes | pain in both feet | 10 to 4 |
| G | foot | 25 minutes | pain in both feet | 10 to 8 |
| H | foot | 25 minutes | pain in right foot | 10 to 8 |
| I | foot | 25 minutes | pain in left foot | 10 to 4 |
| J | foot | 25 minutes | pain in left foot | 10 to 5 |

Average change in pain: 10 to 6.25

Figure 18:
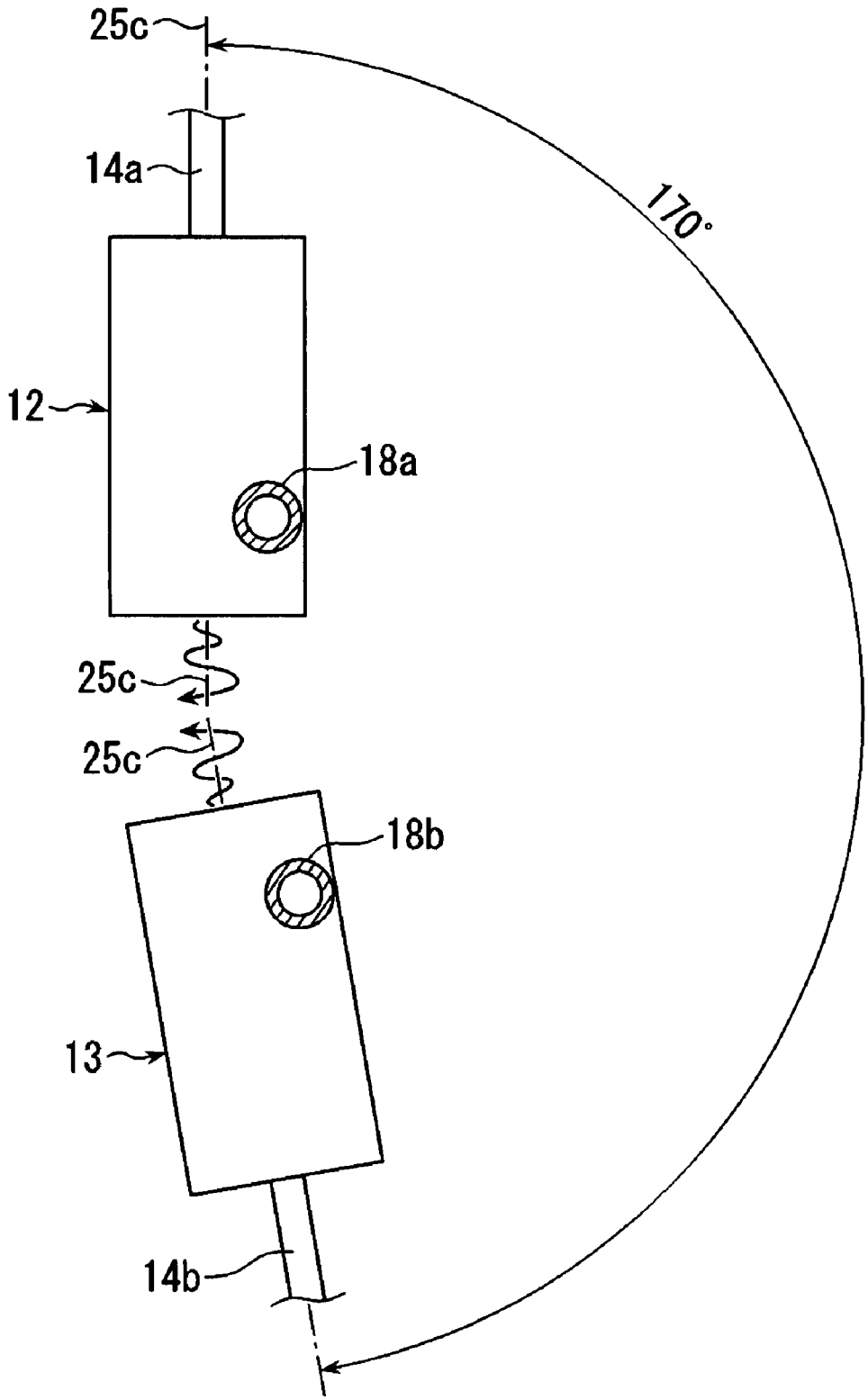
FIG. 18 is a plan view illustrating yet another embodiment relating to an arrangement of two fine-bubble generating sections.

Lastly, in an embodiment shown in FIG. 18, two of the fine-bubble generating sections 12 and 13 are arranged so that the center lines 25*c* of the fluid rotating chambers 25 (see FIGS. 5 and 6) form an angle of 170 degrees. A fluid mixed with the fine bubbles NB is spouted from the spout 28*a* of the fine-bubble generating section 12 while rotating left-handed, and a fluid mixed with the fine bubbles NB is spouted from the spout 28*b* of the fine-bubble generating section 13 while rotating right-handed. When the subjects (A to J) used the foot-bathing apparatus with the above arrangement, the pain-relieving effects were examined. The results obtained are shown in Table 11. From Table 11, it is seen that the "average change in pain" is "10 to 6.4" meaning some mitigation of the pain of the subjects by using the foot-bathing apparatus with the arrangement shown in FIG. 18; however, the effects still did not reach the pain-relieving effects of the foot-bathing apparatus 10 shown in FIGS. 8 and 9 as with the other embodiments described above.

TABLE 11

| Subject | Immersed part | Period of immersion | Condition | Change in pain |
|---|---|---|---|---|
| A | foot | 25 minutes | pain in left lower limb | 10 to 4 |
| B | foot | 25 minutes | pain in left foot | 10 to 6 |
| C | foot | 25 minutes | pain in left foot | 10 to 7 |
| D | foot | 25 minutes | pain in right foot | 10 to 10 |
| E | foot | 25 minutes | pain in left foot | 10 to 7 |
| F | foot | 25 minutes | pain in right lower limb | 10 to 6 |
| G | foot | 25 minutes | pain in both feet | 10 to 4 |
| H | foot | 25 minutes | pain in both feet | 10 to 5 |
| I | foot | 25 minutes | pain in right lower limb | 10 to 7 |
| J | foot | 25 minutes | pain in right lower limb | 10 to 8 |

Average change in pain: 10 to 6.4

In the present embodiment, as the two fine-bubble generating sections 12 and 13 are arranged so that the center lines 25*c* of the fluid rotating chambers 25 (see FIG. 6) form an angle of 170 degrees, the arrangement is most similar to the arrangement of the fine-bubble generating sections 12 and 13 of the foot-bathing apparatus 10 shown in FIGS. 8 and 9. Nevertheless, the pain-relieving effects turned out to be considerably inferior to the effects of the foot-bathing apparatus 10. On the basis of these results, it has been proved that the most excellent pain-relieving effect is obtained when the two fine-bubble generating sections 12 and 13 are arranged so that the center lines 25*c* of the fluid rotating chambers 25 (see FIGS. 5 and 6) form an angle of 180 degrees or are positioned in alignment with each other and, at the same time, the rotating directions of the rotational flows R in the fine-bubble generating sections 12 and 13 are the same.

In order to obtain the same degree of pain-relieving effect as the foot-bathing apparatus 10, the angle formed by the center lines 25*c* of the fluid rotating chambers 25 (see FIG. 6) of the fine-bubble generating sections 12 and 13 is limited within a range of 180±5 degrees. If the angle is out of this range, the pain-relieving effect drops to the level shown in Table 11. Therefore, the preferred angle formed by the center lines 25*c* of the fluid rotating chambers 25 (see FIGS. 5 and 6) of the fine-bubble generating sections 12 and 13 is within a range of 180±5 degrees. In particular, 180 degree is most preferable with which the most excellent pain-relieving effect is obtained.

Figure 19:
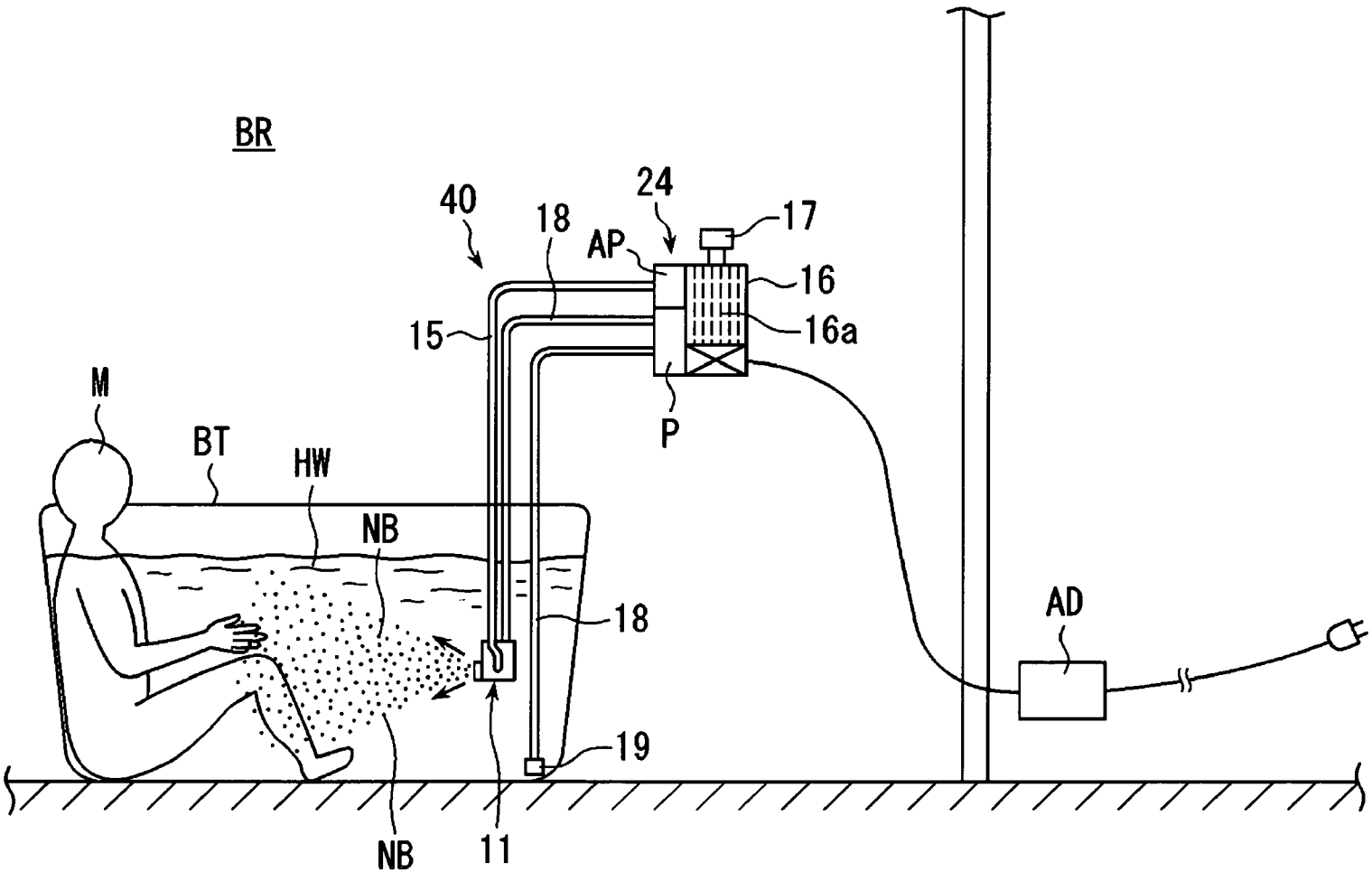
FIG. 19 is a drawing illustrating a bathing device of an embodiment of the present invention in use.
Figure 20:
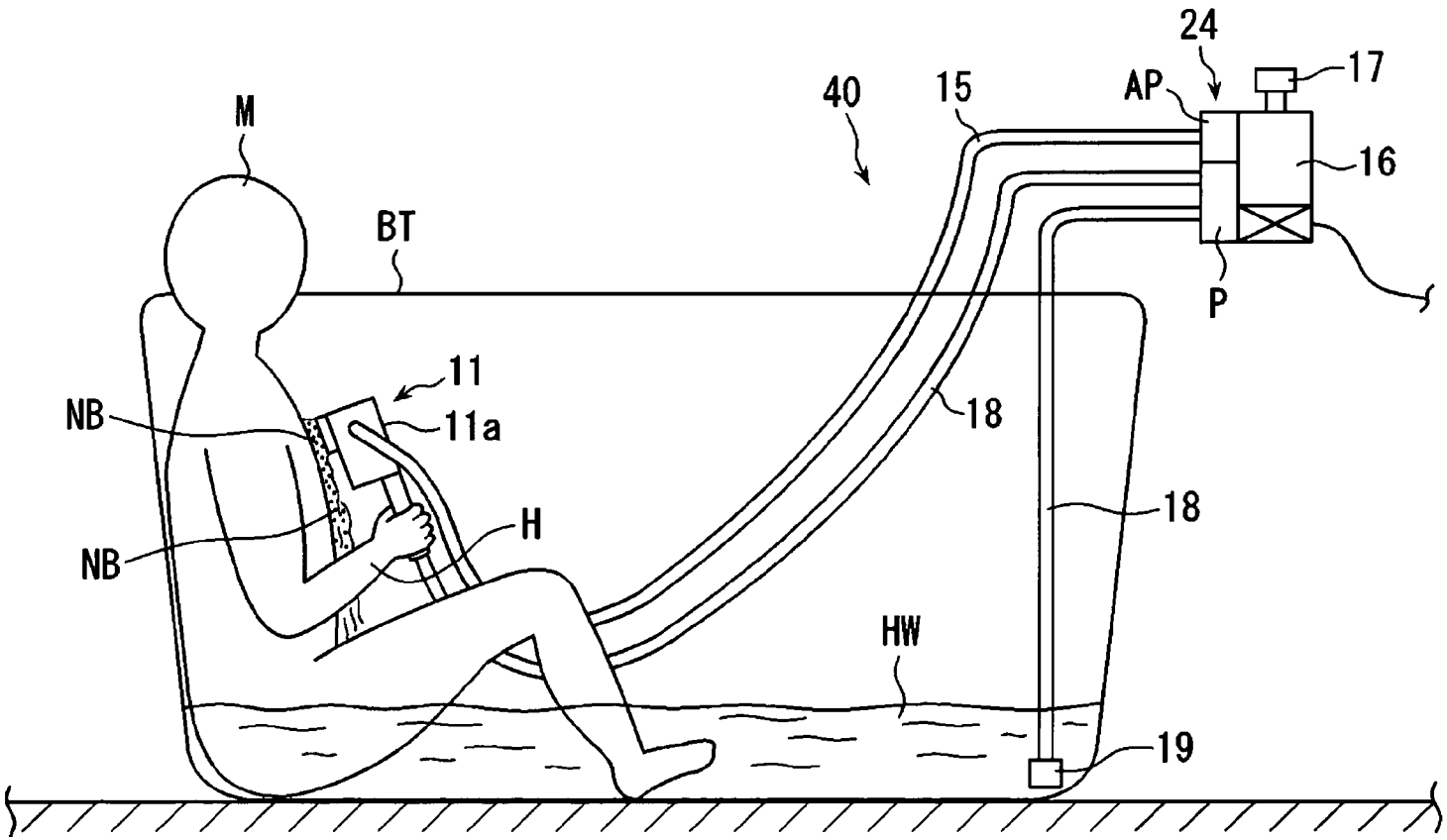
FIG. 20 is a drawing illustrating the bathing device in FIG. 19 in another use.

Next, referring to FIGS. 19 and 20, a bathing device of an embodiment of the present invention is explained. FIG. 19 is a drawing illustrating a bathing device of an embodiment of the present invention in use, and FIG. 20 is a drawing illustrating the bathing device in FIG. 19 in another use.

As shown in FIG. 19, a bathing device 40 of the present embodiment comprises the fine-bubble generator 11 and a gas-liquid supplying unit 24 disposed outside a bathtub BT for supplying the hot water HW and air to the fine-bubble generator 11. The fine-bubble generator 11, during use, is submerged in the hot water HW in the bathtub BT inside a bathroom BR or, as shown in FIG. 20 described later, is held by a hand of a bather M in the bathtub BT. As shown in FIG. 19, a liquid (the hot water HW) mixed with the fine-bubbles NB can be discharged from the fine-bubble generator 11 into the hot water HW in the bathtub BT or, as shown in FIG. 20, a liquid (the hot water HW) mixed with the fine-bubbles NB can be discharged toward a part of the body of the bather M. The structure, function and effect of the above fine-bubble generator 11 are the same as those of the fine-bubble generator 11 shown in FIGS. 1 to 6.

As described in FIGS. 1 to 6, two of the fine-bubble generating sections 12 and 13 are disposed in the fine-bubble generator 11, and the gas-liquid supplying unit 24 is provided with the pump P for circulating and supplying the hot water HW in the bathtub BT to the fine-bubble generating sections 12 and 13 via the liquid introducing passage 18, the air pump AP for supplying air in the atmosphere to the fine-bubble generating sections 12 and 13 via the gas introducing passages 15, 14*a* and 14*b*, the oxygen enriching device 16 for increasing an oxygen concentration in the air supplied to the fine-bubble generating sections 12 and 13, and the filter 17 for removing impurities such as dust when sucking the air from the atmosphere. At a suction port of the liquid introducing passage 18, the filter 19 is mounted for filtering a liquid. The gas-liquid supplying unit 24 is activated by a direct current obtained by stepping down and rectifying an AC 100 V current supplied from commercial power with a power adapter AD.

The gas introducing passage 15 is divided into the two gas introducing passages 14*a* and 14*b* by the branching member 23, and air is sucked from the atmosphere with the air pump AP through the filter 17. The air enriched with oxygen while passing through the oxygen enriching device 16 is supplied to the fine-bubble generating sections 12 and 13 in the fine-bubble generator 11 via the gas introducing passages 14*a* and 14*b*. The hot water HW in the bathtub BT sucked through the filter 19 with the pump P mounted on the gas-liquid supplying unit 24 is supplied to the fine-bubble generating sections 12 and 13 via the liquid introducing passage 18 and the liquid introducing passages 18*a* and 18*b* branched therefrom.

The fine-bubble generator 11 submerged in the hot water HW in the bathtub BT is formed by disposing the two fine-bubble generating sections 12 and 13 inside the substantially rectangular parallelepiped casing 11*a*. These fine-bubble generating sections 12 and 13 are, as shown in FIGS. 5 and 6, arranged in the casing 11*a* with the spouts 28*a* and 28*b* to face each other in alignment with each other.

As shown in FIG. 19, the pump P and the air pump AP of the gas-liquid supplying unit 24 are operated while the fine-bubble generator 11 and the filter 19 of the liquid introducing passage 18 are submerged in the hot water HW in the bathtub BT. Then, the hot water HW sucked from the bathtub BT through the filter 19 and the liquid introducing passage 18 flows into the fluid rotating chamber 25 via the liquid introducing passage 18*b* from the liquid introducing port 27. At the same time, with a feeding force of the air pump AP, air sucked from the atmosphere continuously flows into the negative-pressure zone V in the fluid rotating chamber 25 via the gas introducing passages 15, 14*a* and 14*b* from the gas introducing port 26, thereby forming the rotational flow R with the hot water HW fed into the fluid rotating chamber 25 (see FIG. 6). Next, the air is mixed with the liquid (the hot water HW) forming the rotational flow R and forms the fluid (the hot water HW) mixed with the fine bubbles NB, which is spouted from the spouts 28*a* and 28*b* into the mixing chamber 29 to collide, circulates in the mixing chamber 29, and then is discharged from the discharge port 29*a* into the hot water HW in the bathtub BT.

Thus, by discharging the fluid (the hot water HW) mixed with the fine bubbles NB from the discharge port 29*a* into the hot water HW, oxygen, nitrogen or the like can be supplied to and dissolved into the hot water HW in the bathtub BT. Accordingly, the fluid (the hot water HW) mixed with the fine bubbles NB containing a high amount of dissolved oxygen or the like evenly circulates in the bathtub BT, providing a blood circulation enhancing effect, a heating effect, a sedating effect, and an autonomic nerve controlling effect to the bather M bathed in the hot water HW.

The above-described blood circulation enhancing effect, heating effect, sedating effect, and autonomic nerve controlling effect influence not only the part to which the fluid (the hot water HW) mixed with the fine bubble NB is directly applied but also other regions of the body. Therefore, it is possible to alleviate or eliminate pain in feet and the lumbar region such as arthritic pain or muscle pain. Furthermore, the bathing device 40 can be used simply by putting the fine-bubble generator 11 into the hot water HW and operating the pump P and the air pump AP of the gas-liquid supplying unit 24 while the bather M is bathing in the hot water HW in the bathtub BT, which leads to an extremely easy use.

In the above-described embodiments, one set of the pump P and the air pump AP is used for supplying a gas (air) and a liquid (the water W, the hot water HW) to the two fine-bubble generating sections 12 and 13 constituting the fine-bubble generator 11. However, the structure is not limited to this, and the pump P and the air pump AP may be provided to each of the two fine-bubble generating sections 12 and 13 individually. In this case, a liquid supply from the pump P and a gas supply from the air pump AP may be controlled separately to each of the fine-bubble generating sections 12 and 13. In addition, in the embodiments, the fine-bubble generator 11 is used to supply fine bubbles to water or hot water, which, however, is not limited. Fluids mixed with fine bubbles may be supplied to other liquids including drinking water, cooking oil, petroleum or the like.

INDUSTRIAL APPLICABILITY

The fine-bubble generator according to the present invention is widely applicable to agriculture, forestry, fishery, the manufacturing industry, aquafarming, drinking water manufacturing, the brewing industry, the food-processing industry as well as restaurant business, the cleaning industry, the wastewater treatment industry, or the like.

The invention claimed is:

1. A fine-bubble generator comprising:

two fine-bubble generating sections, each of the fine-bubble generating sections including:

a fluid rotating chamber defined by a circumferential wall around an imaginary center line, and partition walls arranged at both ends of the circumferential wall in the direction of the imaginary center line;

a liquid introducing passage configured so as to communicate with the fluid rotating chamber for introducing a liquid along a direction that forms a position twisted relative to the imaginary center line;

a gas introducing passage opened in a first one of the partition walls of the fluid rotating chamber for introducing a gas into the fluid rotating chamber; and a spout opened in a second one of the partition walls of the fluid rotating chamber;

wherein the two fine-bubble generating sections are arranged so that the spouts of the two fine-bubble generating sections face each other, and so that the fluid rotational flows generated in the fluid rotating chambers of the two fine-bubble generating sections rotate in the same direction.

2. The fine-bubble generator according to claim 1, wherein the two fine-bubble generating sections are arranged to be opposite to each other so that the imaginary center lines of the fluid rotating chambers form an angle of 180±5 degrees.

3. The fine-bubble generator according to claim 2, further comprising a mixing chamber between the two fine-bubble generating sections so as to be located between and in communication with the spouts arranged to face each other; the mixing chamber having a discharge port for discharging a fluid mixed with fine bubbles spouted into the mixing chamber.

4. A foot-bathing apparatus comprising:

a foot-bathing vessel having for accommodating at least a part of a body extremity below an ankle;

the fine-bubble generator according to claim 1 submerged in a liquid contained in the foot-bathing vessel;

a liquid supplying device for supplying a liquid via the liquid introducing passage to the fine-bubble generator; and a gas channel for supplying a gas via the gas introducing passage to the fine-bubble generator.

5. The foot-bathing apparatus according to claim 4, further comprising an oxygen enriching device in a part of the gas channel or the gas introducing passage.

6. A bathing device comprising:

the fine-bubble generator according to claim 1;

a liquid supplying device for supplying a liquid to the fine-bubble generator via the liquid introducing passage; and a gas channel for supplying a gas to the fine-bubble generator via the gas introducing passage.

7. A bathing device according to claim 6, further comprising an oxygen enriching device in a part of the gas channel or the gas introducing passage.

8. The fine-bubble generator according to claim 1, wherein the first one of the partition walls of the fluid rotating chamber of each of the two fine-bubble generating sections has a concave surface, a gas introducing port of the gas introducing passage protruding from the concave surface.

9. The fine-bubble generator according to claim 1, wherein the liquid introducing passage of each of the two fine-bubble generating sections has a liquid introducing port located adjacent to the second one of the partition walls, the liquid introducing port being configured to generate the fluid rotational flow in the fluid rotational chamber.

* * * * *